US010625965B2

(12) United States Patent
Kuriki

(10) Patent No.: US 10,625,965 B2
(45) Date of Patent: Apr. 21, 2020

(54) SHEET FEEDING APPARATUS

(71) Applicant: Brother Kogyo Kabushiki Kaisha, Nagoya (JP)

(72) Inventor: Yuichiro Kuriki, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 16/040,901

(22) Filed: Jul. 20, 2018

(65) Prior Publication Data

US 2019/0031458 A1 Jan. 31, 2019

(30) Foreign Application Priority Data

Jul. 28, 2017 (JP) ..... 2017-147107

(51) Int. Cl.

| | |
|---|---|
| ***B65H 3/06*** | (2006.01) |
| ***B65H 3/56*** | (2006.01) |
| ***B65H 3/52*** | (2006.01) |
| ***B65H 3/34*** | (2006.01) |

(52) U.S. Cl.

CPC ..... *B65H 3/0676* (2013.01); *B65H 3/063* (2013.01); *B65H 3/0653* (2013.01); *B65H 3/0669* (2013.01); *B65H 3/34* (2013.01); *B65H 3/5238* (2013.01); *B65H 3/565* (2013.01); *B65H 2301/4222* (2013.01); *B65H 2402/46* (2013.01); *B65H 2403/942* (2013.01); *B65H 2801/39* (2013.01)

(58) Field of Classification Search

CPC ..... B65H 3/34; B65H 3/063; B65H 3/0661; B65H 3/0676; B65H 3/5238; B65H 9/20; B65H 7/02

See application file for complete search history.

(56) References Cited

U.S. PATENT DOCUMENTS

| | | | | |
|---|---|---|---|---|
| 5,052,676 | A * | 10/1991 | Shiina | B65H 3/5238 271/121 |
| 6,017,031 | A * | 1/2000 | Oosawa | B65H 3/56 271/10.09 |
| 7,410,161 | B2 * | 8/2008 | Yamamoto | B65H 3/063 271/113 |
| 10,015,335 | B2 * | 7/2018 | Shuto | B65H 3/063 |

(Continued)

FOREIGN PATENT DOCUMENTS

JP 2004-269231 A 9/2004

*Primary Examiner* — Patrick Cicchino

(74) *Attorney, Agent, or Firm* — Burr & Brown, PLLC

(57) ABSTRACT

A sheet feeding apparatus includes a support member having a support surface, a feed roller, a stopper, and a restriction member. The stopper includes a restriction surface configured to contact leading edges of sheets supported on the support surface. A tangent extends in parallel to the support surface and passes through a point on an outer peripheral surface of the feed roller, and the tangent and the restriction surface of the stopper crosses at an intersection point. When the stopper moves from a first position to a second position, the intersection point moves with a movement velocity in a direction parallel to the tangent, the movement velocity at the intersection point being defined as a specified movement velocity. The restriction member is configured to restrict movement of the stopper such that the specified movement velocity is greater than or equal to a circumferential velocity of the feed roller.

8 Claims, 11 Drawing Sheets

(56) References Cited

U.S. PATENT DOCUMENTS

| | | | | |
|---|---|---|---|---|
| 10,118,779 | B2 * | 11/2018 | Miyauchi ..... | B65H 1/025 |
| 2006/0097441 | A1 | 5/2006 | Shikan et al. | |
| 2008/0203652 | A1 * | 8/2008 | Yasukawa ..... | B65H 3/063<br>271/117 |

* cited by examiner

SHEET FEEDING APPARATUS

CROSS-REFERENCE TO RELATED APPLICATION

This application claims priority from Japanese Patent Application No. 2017-147107 filed on Jul. 28, 2017, the content of which is incorporated herein by reference in its entirety.

TECHNICAL FIELD

Aspects of the disclosure relate to a sheet feeding apparatus.

BACKGROUND

A known sheet feeding apparatus includes a pick roller, a stopper block and an abutment guide. The pick roller conveys a sheet downstream in a conveying direction in which a sheet is conveyed. The stopper block faces the pick roller and is inclined such that its lower end is located downstream in the conveying direction from its upper end. The abutment guide is disposed in a position such that at least a portion of the abutment guide overlaps the stopper block when viewed in an axial direction of the pick roller. The abutment guide is movable between a sheet setting position and a retreat position.

In this sheet feeding apparatus, leading edges of sheets are aligned by the abutment guide at the setting position. When the pick roller conveys a sheet from stacked sheets, the abutment guide moves from the sheet setting position to the retreat position, causing the leading edges of the stacked sheets to contact the stopper block. The leading edges of the stacked sheets are thus aligned by the stopper block, before the sheet feeding apparatus conveys the stacked sheets downstream.

SUMMARY

In the known sheet feeding apparatus, when the abutment guide retreats to its retreat position, a stack of sheets may collide with the stopper block, and some of the sheets may be forced out of alignment at the stopper block. In this case, some sheets left out of alignment are likely to be collectively fed at one time downstream in the conveying direction.

In response to the above issue, one or more aspects of the disclosure are directed to a sheet feeding apparatus that prevents multiple sheets from being fed at one time.

A sheet feeding apparatus according to one aspect of the disclosure includes a support member having a support surface configured to support stacked sheets, a feed roller, a separation roller, a separator, a stopper, and a restriction member. The feed roller is rotatable about a rotation axis located below a portion of the support surface. The feed roller has an outer peripheral surface. At least a portion of the outer peripheral surface protrudes through the support surface. The feed roller is configured to feed the sheets supported on the support surface downstream in a conveying direction. The separation roller is disposed downstream from the feed roller in the conveying direction. The separation roller is configured to separate a single sheet from the sheets fed by the feed roller and convey the sheet downstream in the conveying direction. The separator is disposed upstream from the separation roller in the conveying direction. The separator has an upper end and a lower end. The lower end is located downstream from the upper end in the conveying direction. When viewed in a direction of the rotation axis, the stopper is disposed at least partially overlapping the separator. The separator is movable between a first position in which the stopper crosses the support surface and restricts leading edges of the sheets supported on the support surface and a second position, downstream from the first position in the conveying direction, in which the stopper is spaced apart from the support surface. The restriction member is configured to hold the stopper in the first position and to restrict movement of the stopper while continuing to support the stopper moving from the first position to the second position. The stopper includes a restriction surface configured to contact the leading edges of the sheets supported on the support surface. When viewed in the direction of the rotation axis, a tangent extends in parallel to the support surface and passes through a point on an outer peripheral surface of the feed roller, and the tangent and the restriction surface of the stopper crosses at an intersection point. When the stopper moves from the first position to the second position, the intersection point moves with a movement velocity in a direction parallel to the tangent, the movement velocity at the intersection point being defined as a specified movement velocity. The restriction member is configured to restrict movement of the stopper such that the specified movement velocity is greater than or equal to a circumferential velocity of the feed roller.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

An illustrative embodiment of the disclosure will be described with reference to the accompanying drawings.

Figure 1:
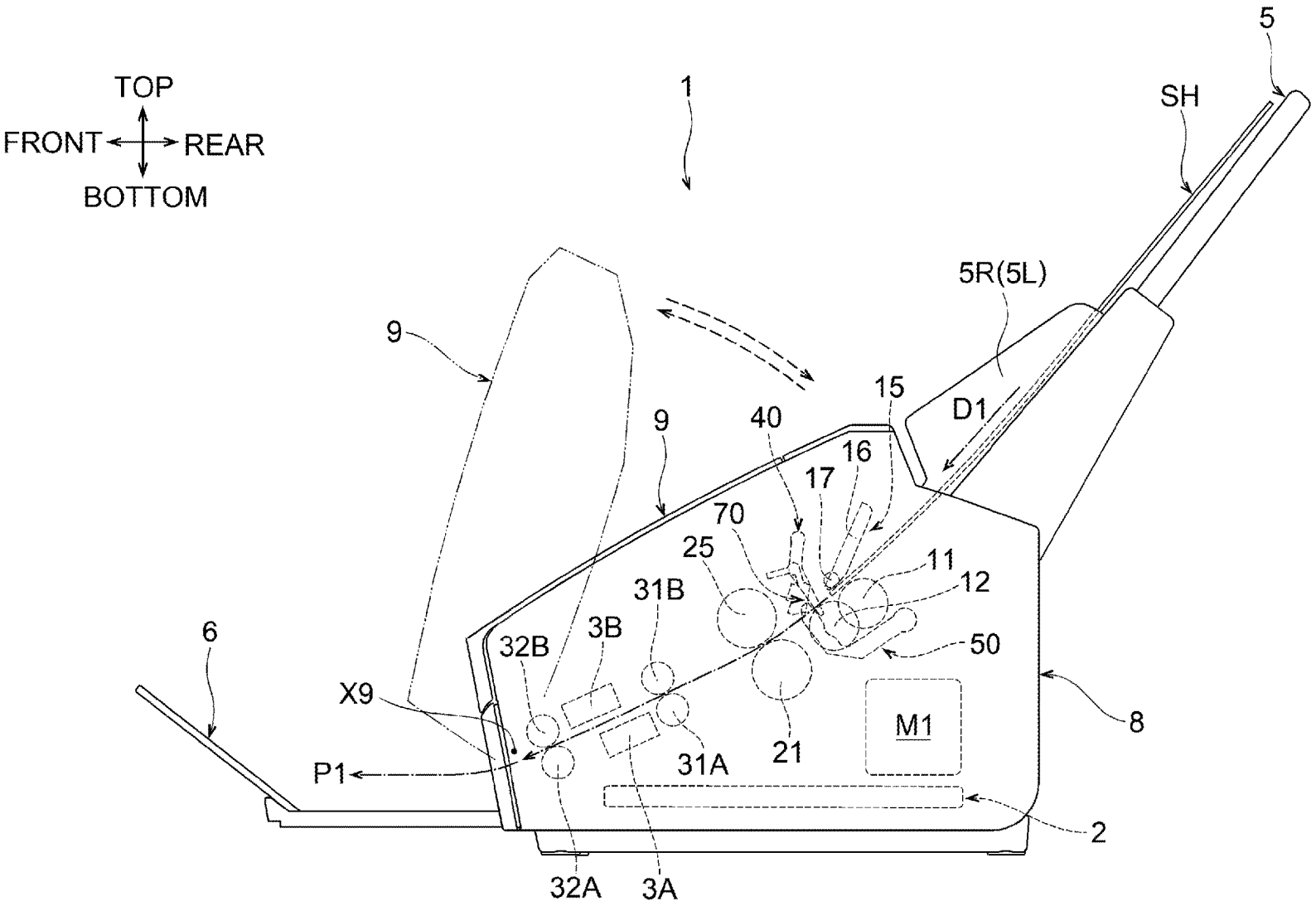
FIG. 1 is a schematic side view of an image reading apparatus according to an embodiment of the disclosure.

As illustrated in FIG. 1, an image reading apparatus 1 is an example of a sheet feeding apparatus of the disclosure. In FIG. 1, one end of the image reading apparatus 1 having a discharge tray 6 is the front, and one side of the image reading apparatus 1 on the left when viewed in the direction facing the discharge tray 6, out of the sheet is the left. The front, rear, left, right, up, and down shown in FIG. 2 and subsequent drawings are the directions in FIG. 1. The components of the image reading apparatus 1 will be described with reference to FIG. 1 and other drawings.

<Overall Structure>

Figure 2:
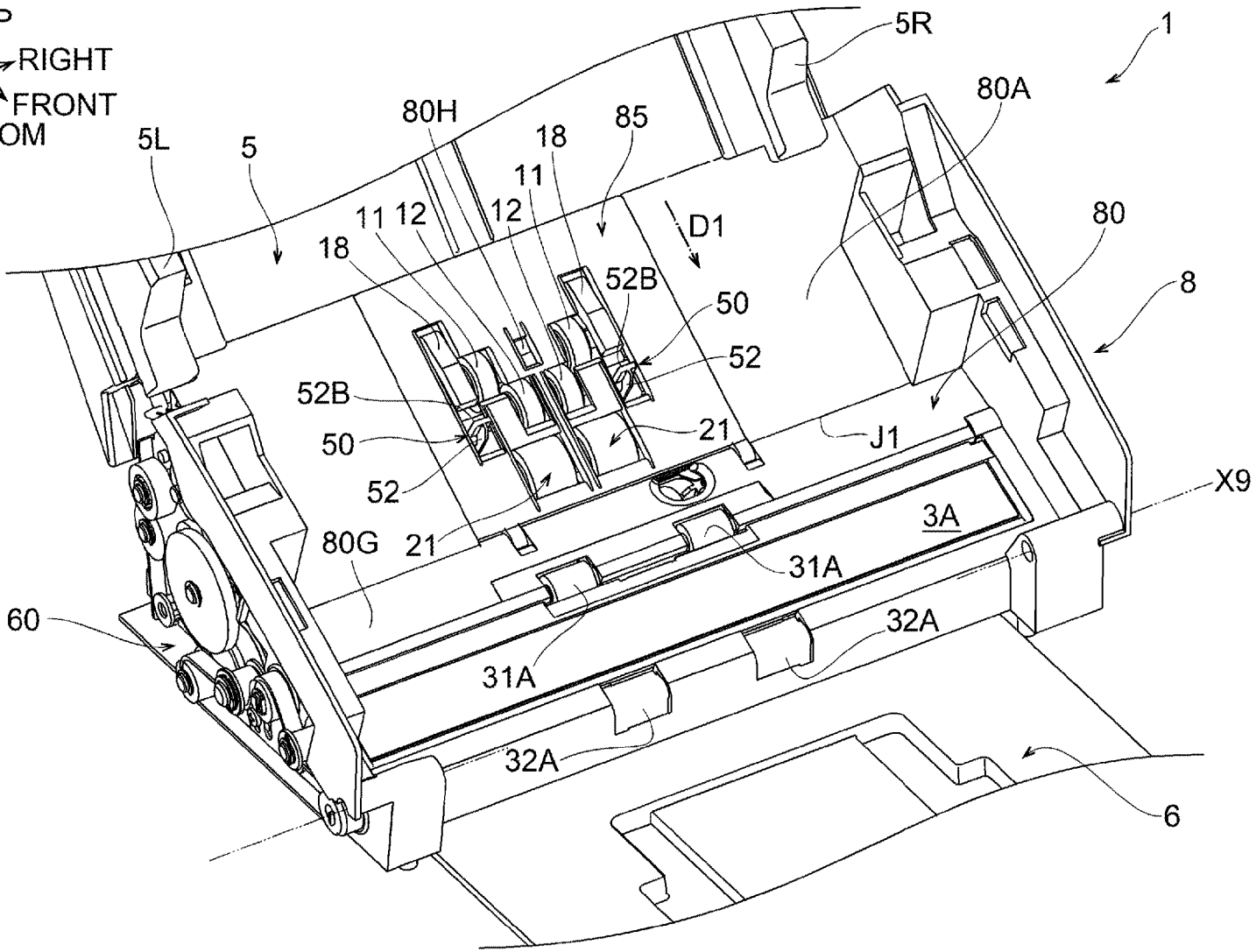
FIG. 2 is a perspective view of a first casing.
Figure 3:
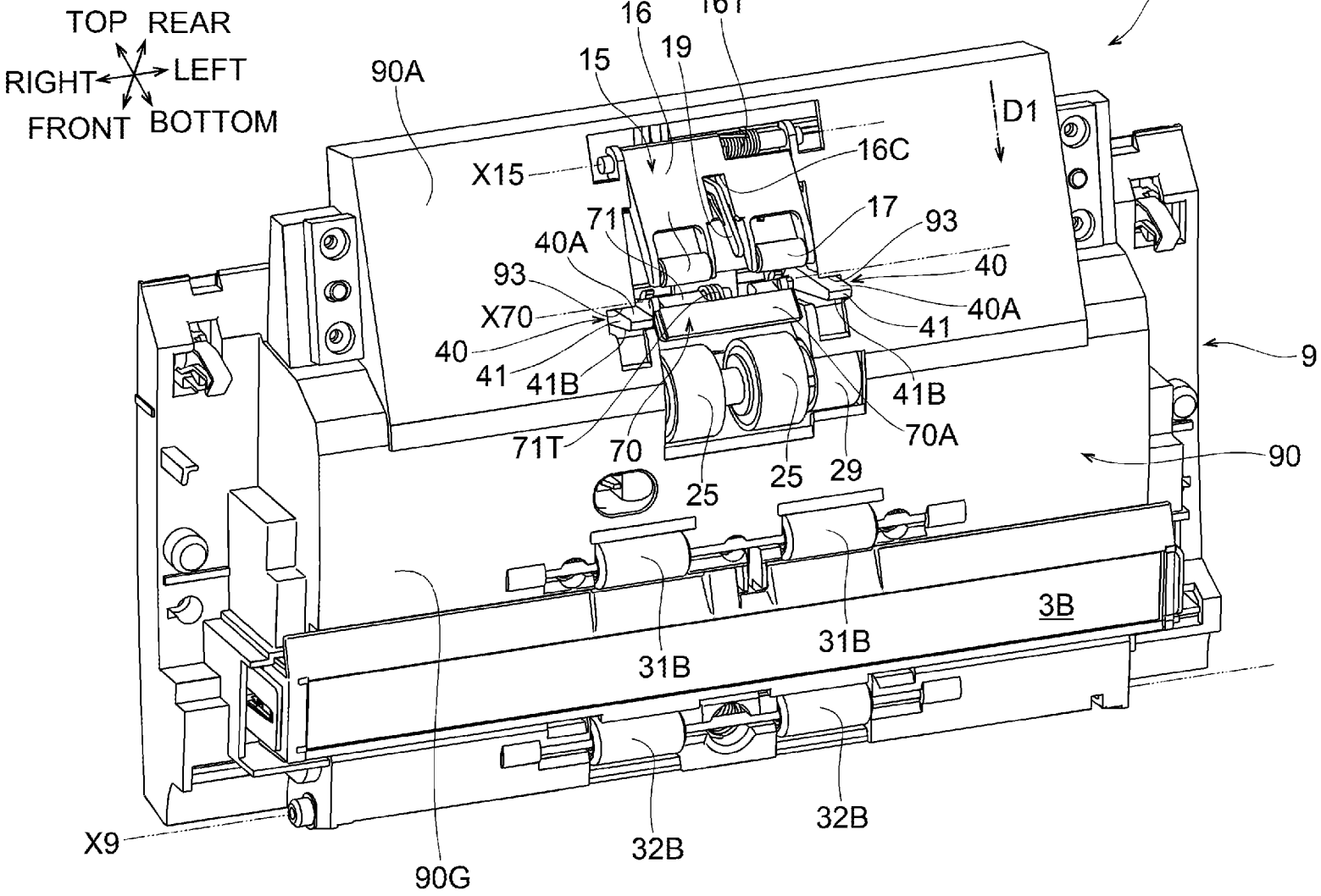
FIG. 3 a perspective view of a second casing.

As illustrated in FIGS. 1-3, the image reading apparatus 1 includes a first casing 8, a second casing 9, a feed tray 5, and a discharge tray. The second casing 9 is disposed over the upper surface of the first casing 8. The second casing 9 has a front-end portion connected to the first casing 8 and is pivotable about an axis X9 extending in a left-right direction.

Figure 4:
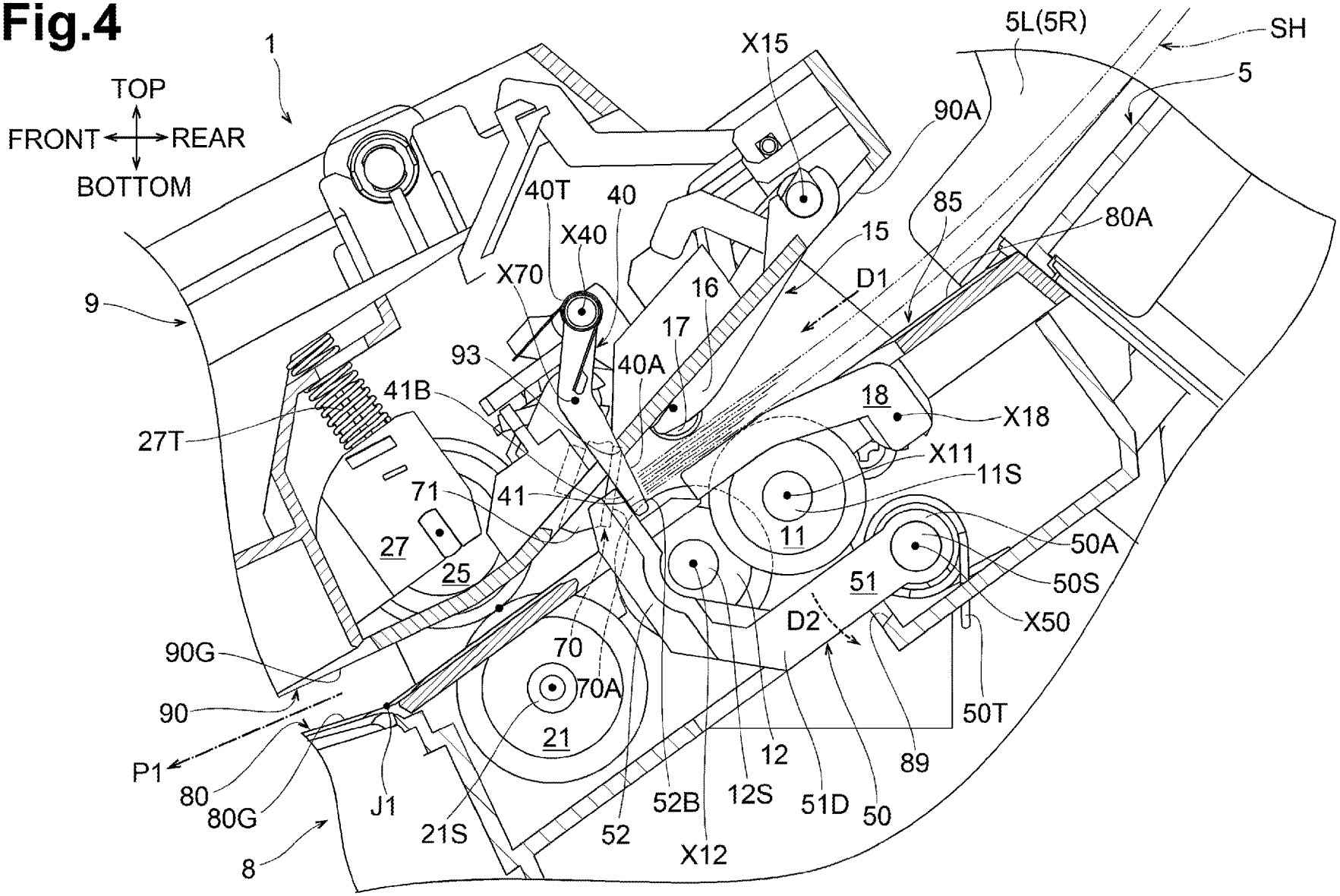
FIG. 4 is a partial sectional view of the image reading apparatus.

As illustrated in FIGS. 2 and 4, the first casing 8 includes a lower chute 80. The lower chute 80 is an example of a support member of the disclosure. The first casing 8 has an upper surface defined by an upper surface of the lower chute 80.

The upper surface of the first casing 8 is inclined downward from a rear end of the first casing 8 toward a front end thereof. The upper surface of the first casing 8 has a front area and a rear area relative to a reference line J1 located in a middle of the upper surface in a front-rear direction. The front area is inclined shallower than the rear area. The rear area includes a support surface 80A. The front area includes a lower conveyance surface 80G.

Figure 5:
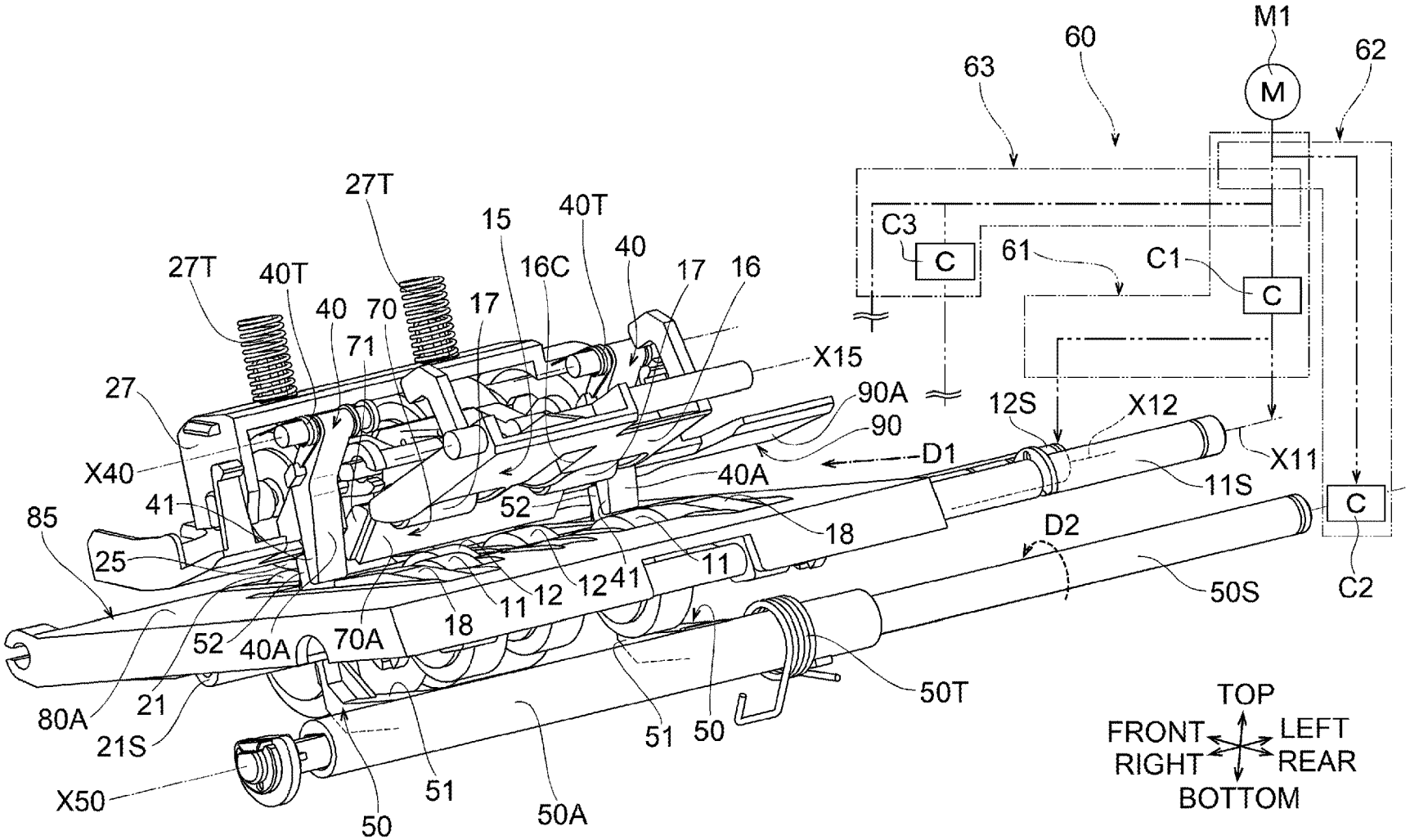
FIG. 5 is a perspective view of a first feed roller, a second feed roller, a pressing member, a separator, stoppers, restriction members, and other components.

As illustrated in FIGS. 2, 4 and 5, the lower chute 80 includes a lower cover 85, which is openable for maintenance. The lower cover 85 has an upper surface defining a central portion of the support surface 80A in the left-right direction.

As illustrated in FIGS. 3 and 4, the second casing 9 includes an upper chute 90. The second casing 9 has a lower surface defined by a lower surface of the upper chute 90.

The lower surface of the second casing 9 is included downward from a rear end of the second casing 9 toward a front end thereof. The lower surface of the second casing 9 includes a guide surface 90A in an area facing the support surface 80A of the first casing 8. The lower surface of the second casing 9 includes an upper conveyance surface 90G in an area facing the lower conveyance surface 80G of the first casing 8. The upper conveyance surface 90G is inclined shallower than the guide surface 90A. As illustrated in FIG. 4, the guide surface 90A of the second casing 9 is inclined such that a more downstream portion of the guide surface 90A from the rear end thereof is closer to the support surface 80A of the first casing 8 in a frontward direction. In other words, a space between the support surface 80A and the guide surface 90A tapers frontward.

As illustrated in FIGS. 1 and 2, the feed tray 5 is connected to a rear end of the first casing 8, and inclined upward toward the rear. The feed tray 5 includes, on its upper surface, the width-restriction guides 5L, 5R that are slidable in the left-right direction. The width-restriction guides 5L, 5R are movable toward or away from each other relative to a center of the feed tray 5 in the left-right direction. The width-restriction guides 5L, 5R thus align sheets SH of various sizes, such as sheets that, for example, are business-card sized or A4-sized, on the feed tray 5 in the left-right direction.

The discharge tray 6 extends frontward from a position below the lower conveyance surface 80G, which is located at a front-end portion of the first casing 8.

As illustrated in FIG. 1, the upper surface of the first casing 8 and the lower surface of the second casing 9 define a conveying path P1 therebetween. The conveying path P1 is defined as a space between the support surface 80A and lower conveyance surface 80G of the first casing 8 illustrated in FIG. 2 and the guide surface 90A and upper conveyance surface 90G of the second casing 9 illustrated in FIG. 3.

As illustrated in FIGS. 1 and 4, stacked sheets SH each having an image to be read are supported across the feed tray 5 and the support surface 80A. Each sheet SH is conveyed along the conveying path P1 in a conveying direction D1, and discharged to the discharge tray 6. The conveying direction D1 is directed from the feed tray 5 disposed at the upstream side toward the discharge tray 6 disposed at the downstream side. The conveying path P1 is inclined downward from the upstream side to the downstream side in the conveying direction D1. In the embodiment, a left-right direction is perpendicular to the conveying direction D1, and is equal to a width direction of the image reading apparatus 1.

The second casing 9 is pivotable about an axis X9 such that its upper rear end portion moves frontward or rearward as illustrated by phantom lines in FIG. 1. The second casing 9 moves apart from the upper surface of the first casing 8 to release the conveying path P1.

As illustrated in FIGS. 1-3, the image reading apparatus 1 includes first feed rollers 11, second feed rollers 12, a pressing member 15, set guides 18, a separator 70, stoppers 40, restriction members 50, separation rollers 21, and retard rollers 25, which are disposed along the conveying path P1. The first feed rollers 11 and the second feed rollers 12 are an example of a feed roller of the disclosure.

The image reading apparatus 1 includes conveying rollers 31A, first pinch rollers 31B, a first reader 3A, a second reader 3B, discharge rollers 32A, and second pinch rollers 32B, which are disposed downstream from the separation roller 21 in the conveying direction D1 and along the conveying path P1. The first reader 3A and the second reader 3B are example of a reading portion of the disclosure.

The image reading apparatus 1 includes a controller 2 illustrated in FIG. 1, a motor M1 illustrated in FIGS. 1 and 5, and a transmission device 60 illustrated in FIGS. 2 and 5.

As illustrated in FIG. 1, the controller 2 is disposed at a bottom portion of the first casing 8. The controller 2 is a control circuit board including a CPU and other components. The controller 2 is configured to, during an image reading operation, control the motor M1, the first reader 3A, and the second reader 3B. The controller 2 is configured to receive input commands from the user through an input/output panel (not illustrated), or display the operation state or the settings of the image reading apparatus 1.

<Structure of Transmission Device>

As illustrated in FIG. 2, the transmission device 60 is disposed to the left in the first casing 8 and covered by a left side cover of the first casing 8. The transmission device 60 may include a train of gears, or a pully and a belt. Although not illustrated, the motor M1 is disposed adjacent to the transmission device 60 in the first casing 8.

As illustrated in FIG. 5, the motor M1 rotates forward or backward under the control of the controller 2 to generate a drive force, which is transmitted to the transmission device 60. The transmission device 60 includes a first transmission device 61, a second transmission device 62, a third transmission device 63, and one-way clutches C1, C2, C3. The second transmission device 62 and the third transmission device 63 use components including a train of gears, or a pulley and a belt, in common with the first transmission device 61 in their upstream portions of transmission paths for transmitting the drive force of the motor M1. The second transmission device 62 and the third transmission device 63 branch off from the first transmission device 61 in their middle portions of the transmission paths.

The first transmission device 61 connects the motor M1 with the first feed rollers 11 and the second feed rollers 12 via the one-way clutch C1 and rotation shafts 11S, 12S.

When the motor M1 rotates forward, the one-way clutch C1 becomes engaged, the first transmission device 61 transmits the drive force of the motor M1 to the first feed rollers 11 and the second feed rollers 12, and thus the first feed rollers 11 and the second feed rollers 12 rotate in the conveying direction D1. When the motor M1 rotates backward, the one-way clutch C1 becomes disengaged, and the drive force of the motor M1 is not transmitted to the first feed rollers 11 and the second feed rollers 12.

The second transmission device 62 connects the motor M1 with the restriction members 50 via the one-way clutch C2 and the transmission shaft 50S. The one-way clutch C2 is a known clutch such as a sprag clutch or a cam clutch, and includes an inner race and an outer race, which are coaxial with each other. The one-way clutch C2 is structured to transmit a torque in one direction between the outer race and the inner race. The one-way clutches C1, C3 may have a structure similar to or different from the one-way clutch C2.

Although not illustrated, the inner race of the one-way clutch C2 is fixed to the left end of the transmission shaft 50S in a manner rotatable together. The outer race of the one-way clutch C2 is fixed to a gear, which is located at the most downstream portion of a transmission path of the second transmission device 62, in a manner rotatable together.

When the motor M1 rotates backward, the one-way clutch C2 becomes engaged, the second transmission device 62 transmits the drive force of the motor M1 to the transmission shaft 50S. When the motor M1 rotates forward, the one-way clutch C2 becomes disengaged, and the drive force of the motor M1 is not transmitted to the transmission shaft 50S. The transmission shaft 50S and the restriction members 50 will be described later.

The third transmission device 63 connects the motor M1 with the separation rollers 21 via the one-way clutch C3 and a rotation shaft 21S illustrated in FIGS. 4 and 5. The third transmission device 63 connects the motor M1 with the conveying rollers 31A and the discharge rollers 32A via a rotation shaft (not illustrated) of the conveying rollers 31A illustrated in FIG. 2 and a rotation shaft (not illustrated) of the discharge rollers 32A illustrated in FIG. 2.

When the motor M1 rotates forward, the one-way clutch C3 illustrated in FIG. 5 becomes engaged, and the third transmission device 63 transmits the drive force of the motor M1 to the separation rollers 21. In this state, the third transmission device 63 transmits the drive force of the motor M1 to the conveying rollers 31A and the discharge rollers 32A not via the one-way clutch C3. The separation rollers 21, the conveying rollers 31A, and the discharge rollers 32A thus rotate in the conveying direction D1. When the motor M1 rotates backward, the one-way clutch C3 becomes disengaged, and the drive force of the motor M1 is not transmitted to the separation rollers 21. In this state, the third transmission device 63 transmits the drive force of the motor M1 to the conveying rollers 31A and the discharge rollers 32A not via the one-way clutch C3. As the conveying rollers 31A and the discharge rollers 32A are spaced apart from sheets SH supported on the support surface 80A, there is little likelihood that failures occur.

<First Feed Rollers and Second Feed Rollers>

As illustrated in FIGS. 2, 4 and 5, the first feed rollers 11 are disposed at two positions apart from each other in the left-right direction. The first feed rollers 11 are fixed to the rotation shaft 11S in a manner rotatable together. The rotation shaft 11S is rotatably supported by a frame (not illustrated) in the first casing 8. The rotation shaft 11S defines a rotation axis X11 extending in the left-right direction, in a position below a portion of the support surface 80A. At least a portion of the outer surface of each of the first feed rollers 11 protrudes through the support surface 80A.

The second feed rollers 12 are disposed downstream from the first feed rollers 11 in the conveying direction D1. The second feed rollers 12 are disposed at two positions apart from each other in the left-right direction as with the first feed rollers 11. The second feed rollers 12 are fixed to the rotation shaft 12S in a manner rotatable together. The rotation shaft 12S is rotatably supported by a frame (not illustrated) in the first casing 8. The rotation shaft 12S defines a rotation axis X12 in a position below a portion of the support surface 80A and downstream from the rotation axis X11 in the conveying direction D1. The rotation axis X12 extends parallel to the rotation axis X11. At least a portion of the outer peripheral surface of each of the second feed rollers 12 protrudes through the support surface 80A.

More specifically, the first feed rollers 11 are disposed in a row in the left-right direction where the rotation shaft 11S extends. The second feed rollers 12 are disposed in a row in the left-right direction where the rotation shaft 12S extends. The row of the first feed rollers 11 is located differently from the row of the second feed rollers 12 in the conveying direction D1. The two second feed rollers 12 are disposed between the two first feed rollers 11 in the left-right direction.

Figure 6:
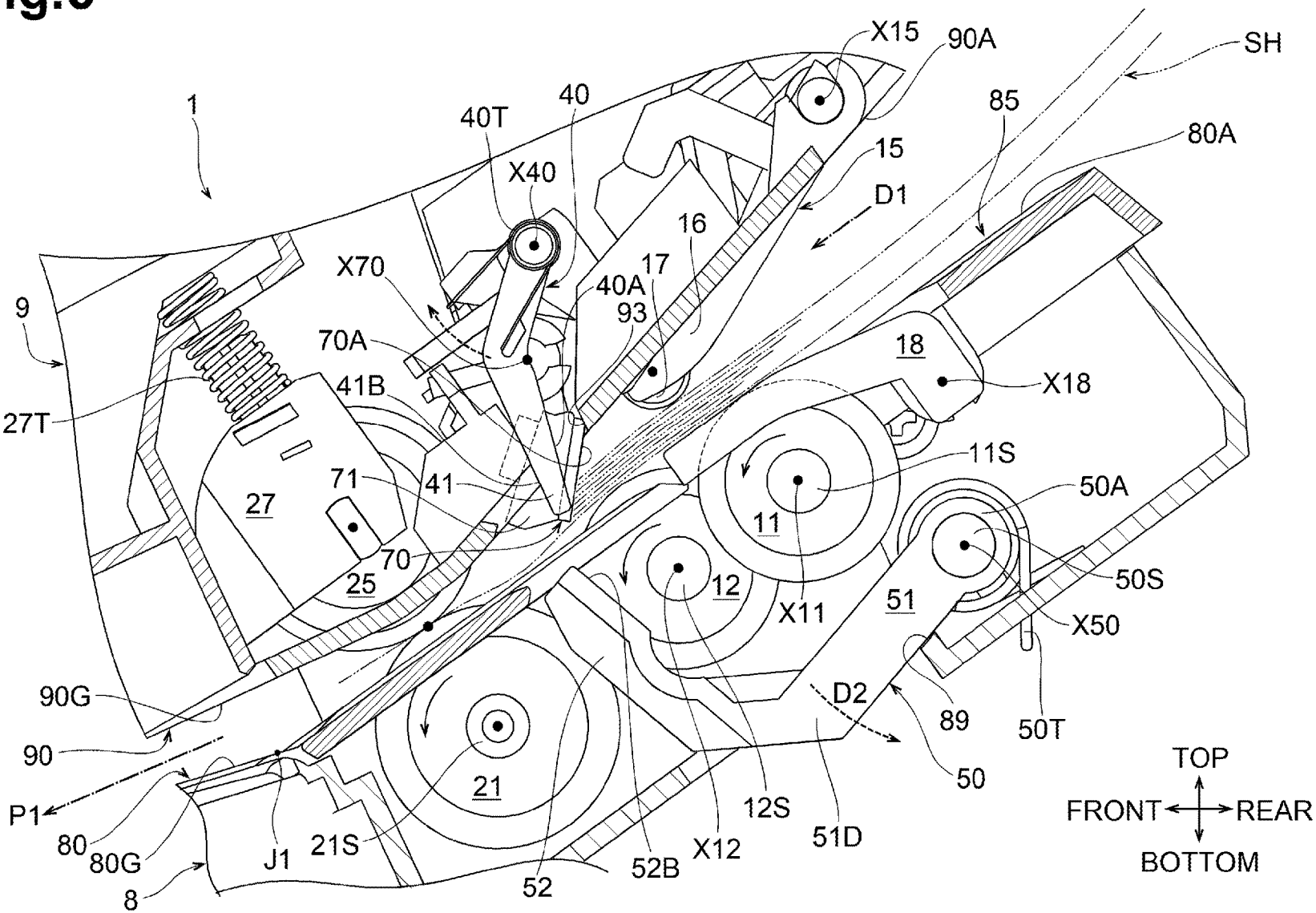
FIG. 6 is a partial sectional view of the image reading apparatus.

When the controller 2 rotates the motor M1 forward, the one-way clutch C1 illustrated in FIG. 5 becomes engaged, and the first transmission device 61 transmits the drive force of the motor M1 to the first feed rollers 11 and the second feed rollers 12. As illustrated in FIG. 6, the first feed rollers 11 and the second feed rollers 12 thus rotate in the conveying direction D1, to feed the sheet SH supported on the support surface 80A downstream in the conveying direction D1 along the conveying path P1.

<Pressing Member>

As illustrated in FIGS. 3, 4, and other drawings, the pressing member 15 includes an arm 16 and two rollers 17. The arm 16 is supported by the upper chute 90 pivotally about a third axis X15. The third axis X15 extends in the left-right direction in a rear end portion of the guide surface 90A of the second casing 9. In other words, the third axis X15 is upstream from the first feed rollers 11 in the conveying direction D1.

The arm 16 is disposed facing the support surface 80A and extends obliquely downward downstream in the conveying direction D1. The arm 16 has its lower end portion supporting the rollers 17 spaced apart in the left-right direction. The arm 16 urges the rollers 17 toward the support surface 80A or downward under the urging force of a helical torsion spring 16T illustrated in FIG. 3. As illustrated in FIG. 4, the rollers 17 are pressed toward the first feed rollers 11 and the second feed rollers 12 by an urging force of the helical torsion spring 16T. This enables the rollers 17 to contact a top sheet SH of one or more sheets supported on the support surface 80A and press the sheets SH against the first feed rollers 11 and the second feed rollers 12.

As illustrated in FIG. 3, the arm 16 has a cutout 16C between the two rollers 17. The second casing 9 pivotally supports a sheet detector 19. The sheet detector 19 extends from the second casing 9 through the cutout 16C of the arm 16 and protrudes downward. Although not illustrated, the sheet detector 19 has a portion located in the second casing 9, and the portion is connected to a shutter to release or block an optical path of a photo interrupter.

As illustrated in FIG. 2, the support surface 80A has a recess 80H between the two first feed rollers 11. Although not illustrated, when no sheets SH are supported on the support surface 80A, a distal end of the sheet detector 19 is in the recess 80H. When one or more sheets SH are supported on the support surface 80A, the distal end of the sheet detector 19 is raised and spaced apart from the recess 80H by the sheets SH. Although not illustrated, the shutter releases or blocks the optical path of the photo interrupter in response to the sheet detector 19, and a signal from the photo interrupter is transmitted to the controller 2. The controller 2 determines whether one or more sheets SH are supported on the support surface 80A based on the signal from the sheet detector 19.

<Set Guides>

As illustrated in FIGS. 2 and 5, the set guides 18 are disposed at two positions apart from each other in the left-right direction. The left-side set guide 18 is disposed to the left of the left-side first feed roller 11. The right-side set guide 18 is disposed to the right of the right-side first feed roller 11.

The set guides 18 extend downstream in the conveying direction D1 and have their upper surfaces exposed from the support surface 80A. As illustrated in FIG. 4, each of the set guides 18 is supported by the lower cover 85 in a manner pivotable about a fourth axis X18. The fourth axis X18 extends in the left-right direction in a position below a portion of the support surface 80A and upstream from the first feed rollers 11 in the conveying direction D1. Each of the set guides 18 is urged by a spring (not illustrated), such that its upper surface is exposed from the support surface 80A.

A leading edge of a sheet SH supported on the support surface 80A is guided by the arm 16 of the pressing member 15 and the set guides 18, and thus the sheet SH is conveyed, without the leading edge being caught at the first feed rollers 11, between the first feed rollers 11, the second feed rollers 12 and the rollers 17 of the pressing member 15.

<Separator>

As illustrated in FIGS. 3-6, the separator 70 is disposed downstream from the rollers 17 of the pressing member 15 in the conveying direction D1 and upstream from the separation rollers 21 in the conveying direction D1. As illustrated in FIG. 5, the separator 70 is disposed facing, from above, a central portion of the support surface 80A in the left-right direction. The separator 70 is disposed such that it contacts sheets SH fed by the first feed rollers 11 and the second feed rollers 12.

The separator 70 is substantially rectangular and made from an elastic material such as rubber or elastomer. The separator 70 is affixed on a separator holder 71. As illustrated in FIGS. 4 and 6, the separator holder 71 is supported by the upper chute 90 in a matter rotatable about a fifth axis X70. The fifth axis X70 extends in the left-right direction in a position above a portion of the guide surface 90A.

As illustrated in FIG. 3, the separator 70 has a left end substantially aligned with a left end surface of a left retard roller 25 in the left-right direction. The separator 70 has a right end substantially aligned with a right end surface of a right retard roller 25 in the left-right direction.

The separator holder 71 is urged toward the support surface 80A by a helical torsion spring 71T illustrated in FIG. 3, and thus maintained in a position illustrated in FIG. 4 and other drawings. The separator 70 is inclined such that its lower end is located downstream from its upper end in the conveying direction D1.

As illustrated in FIGS. 3-6, the separator 70 includes a separation surface 70A. The separation surface 70A is a flat surface facing upstream in the conveying direction D1, inclined relative to the support surface 80A, and facing the support surface 80A. As illustrated in FIGS. 4 and 6, the separation surface 70A has an upper end above a part of the guide surface 90A. The separation surface 70A has a lower end facing the support surface 80A by a small gap. The lower end of the separation surface 70A faces an outer surface of the second feed rollers 12 by a small gap.

As illustrated in FIG. 6, the separation surface 70A is configured to contact leading edges of sheets SH supported on the support surface 80A. The separator 70 is configured to, when the leading edges of the sheets SH collide with the separation surface 70*a*, pivot slightly downstream in the conveying direction D1 due to elastic deformation of the helical torsion spring 71T illustrated in FIG. 3, to lessen the impact of the collision.

<Stoppers>

As illustrated in FIG. 4 and other drawings, the stoppers 40 are disposed downstream from the rollers 17 of the pressing member 15 and upstream from the separation rollers 21 in the conveying direction D1. The stoppers 40 are supported by the upper chute 90 in the second casing 9 in a manner rotatable about the second axis X40.

The second axis X40 is located above a portion of the guide surface 90A and extends in parallel to the rotation axes X11, X12 extending in the left-right direction. The second axis X40 is located above the fifth axis X70 of the separator holder 71 and upstream from the fifth axis X70 in the conveying direction D1.

As illustrated in FIG. 3, the stoppers 40 are exposed from the guide surface 90A, and protrude downward. The stoppers 40 are disposed at two positions apart from each other across the separator 70. The left stopper 40 is to the left of the separator 70, and the right stopper 40 is to the right of the separator 70. As illustrated in FIGS. 4 and 6, which are illustrations viewed in a direction of the rotation axis X11 or X12, which is the left-right direction, the stoppers 40 are disposed at least partially overlapping the separator 70.

As illustrated in FIGS. 3-6, each of the stoppers 40 has an end portion 41. The end portion 41 is shaped like a prism tapering downward. Each of the stoppers 40 includes a restriction surface 40A. The restriction surface 40A is a surface of the end portion 41, facing upstream in the conveying direction D1. As illustrated in FIG. 4, the restriction surface 40A is configured to contact leading edges of sheets SH supported on the support surface 80A.

The stoppers 40 are urged upstream in the conveying direction D1 by helical torsion springs 40T illustrated in FIGS. 4 and 5. As illustrated in FIGS. 3, 4, and other drawings, the upper chute 90 has an opening through which the stoppers 40 protrude. Edges defining the opening includes an upstream edge in the conveying direction D1, which is defined as a positioning edge 93.

The stoppers 40 contact and stop at the positioning edge 93, thus remaining in a first position illustrated in FIGS. 3-5, and 7. When each stopper 40 is in the first position, the end portion 41 crosses the conveying path P1 and the support surface 80A.

Figure 7:
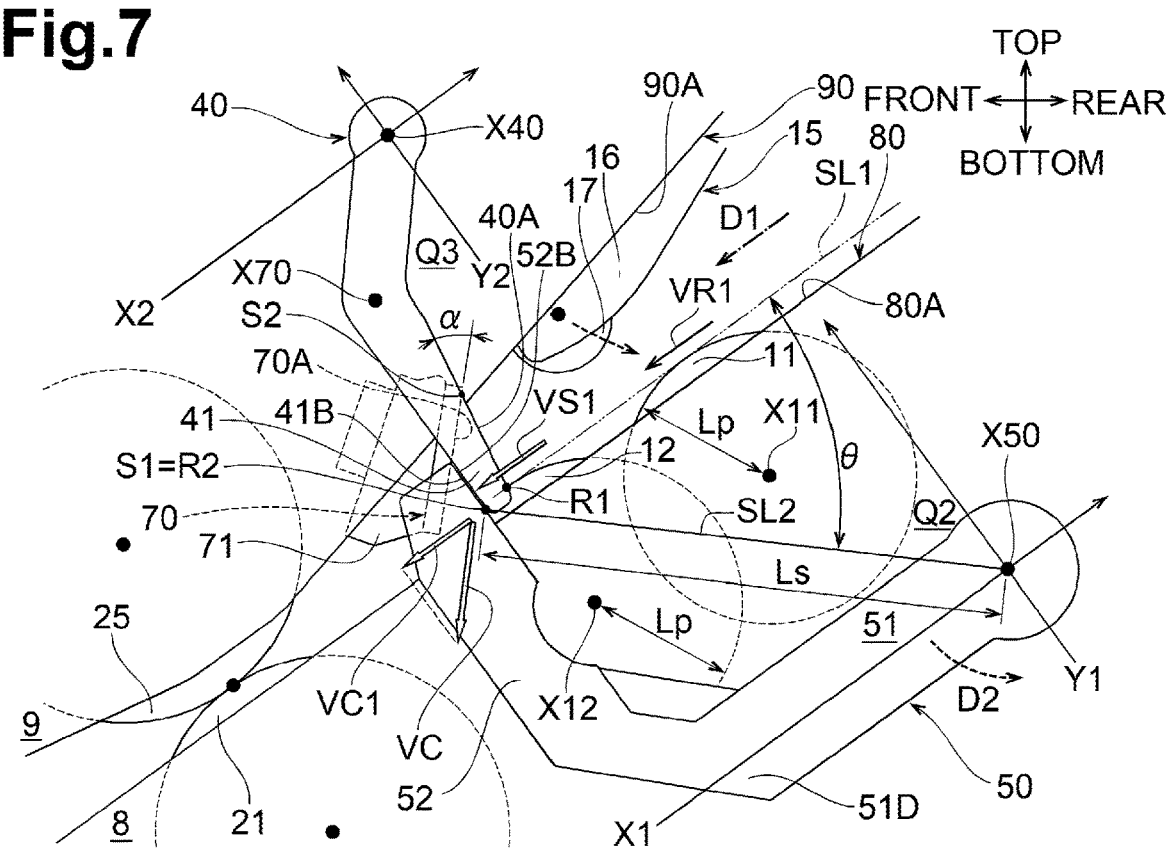
FIG. 7 schematically illustrates relative positional relationships among the first feed roller, the second feed roller, the pressing member, the separator, the stopper, the restriction member, and other components.

As illustrated in FIG. 7, which is an illustration viewed in the direction of the rotation axis X11 or X12, when the stopper 40 is in the first position, the intersection point S2 of the separation surface 70A and the restriction surface 40A is located slightly above a portion of the guide surface 90A. More specifically, when the stopper 40 is in the first position, the restriction surface 40A of the stopper 40 is located upstream from the separation surface 70A of the separator 70 in the conveying direction D1.

The stoppers 40 are pivotable about the second axis X40, downstream in the conveying direction D1, to a second position illustrated in FIG. 6, as their end portions 41 are pressed by sheets SH downstream in the conveying direction D1. When the stoppers 40 move from the first position toward the second position, the end portions 41 of the stoppers 40 move downward in the conveying direction D1 and are separated upward from the support surface 80A.

FIGS. 8, 9, 11, 12, and 14 illustrate the stopper 40 in a midway position between the first position and the second position. FIGS. 10 and 13 illustrates the stopper 40 in the second position.

Figure 8:
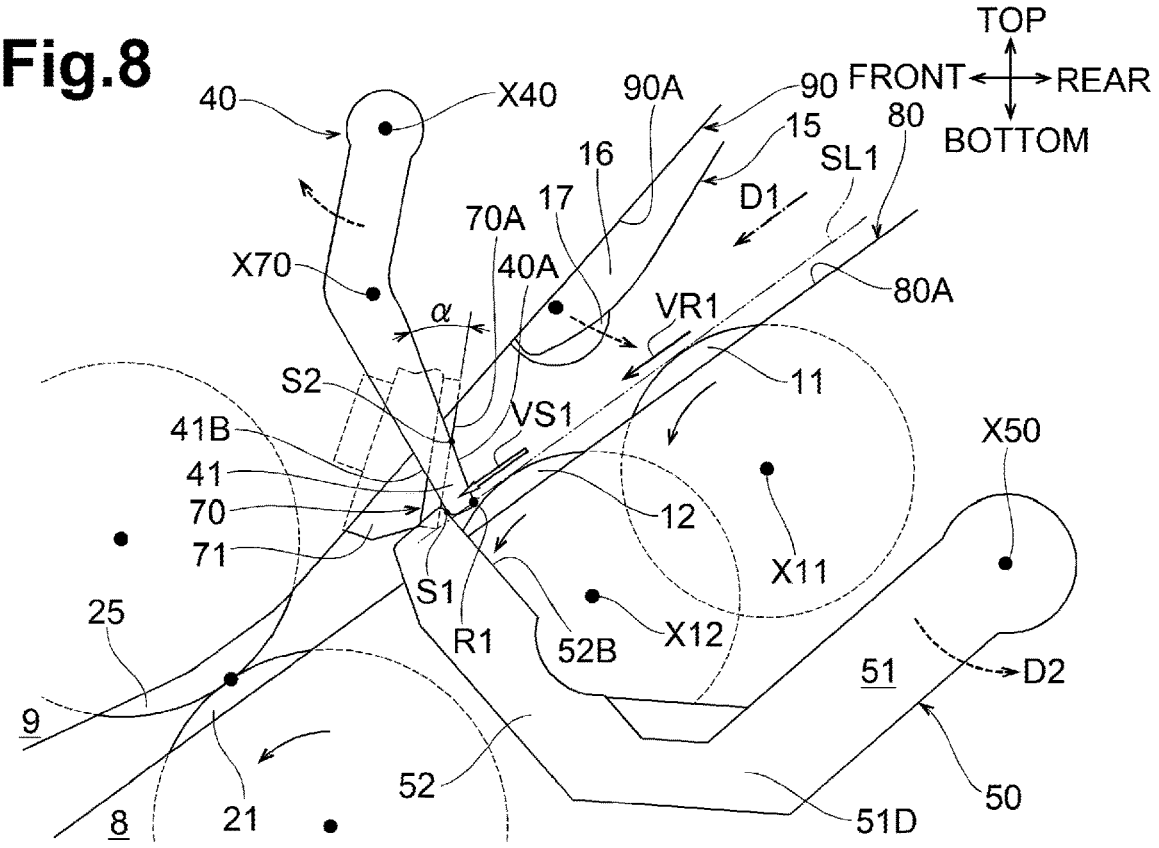
FIG. 8 schematically illustrates relative positional relationships among the first feed roller, the second feed roller, the pressing member, the separator, the stopper, the restriction member, and other components.

As illustrated in FIG. 8, which is an illustration viewed in the direction of the rotation axis X11 or X12, when the stopper 40 moves from the first position toward the second position, the intersection point S2 of the separation surface 70A and the restriction surface 40A moves below a portion of the guide surface 90A. In this state, the restriction surface 40A of the stopper 40 has an upper portion extending upward from the intersection point S2 and a lower portion extending downward from the intersection point S2. The upper portion is located downstream from the separation surface 70A of the separator 70 in the conveying direction D1, while the lower portion is located upstream from the separation surface 70A of the separator 70 in the conveying direction D1.

Figure 9:
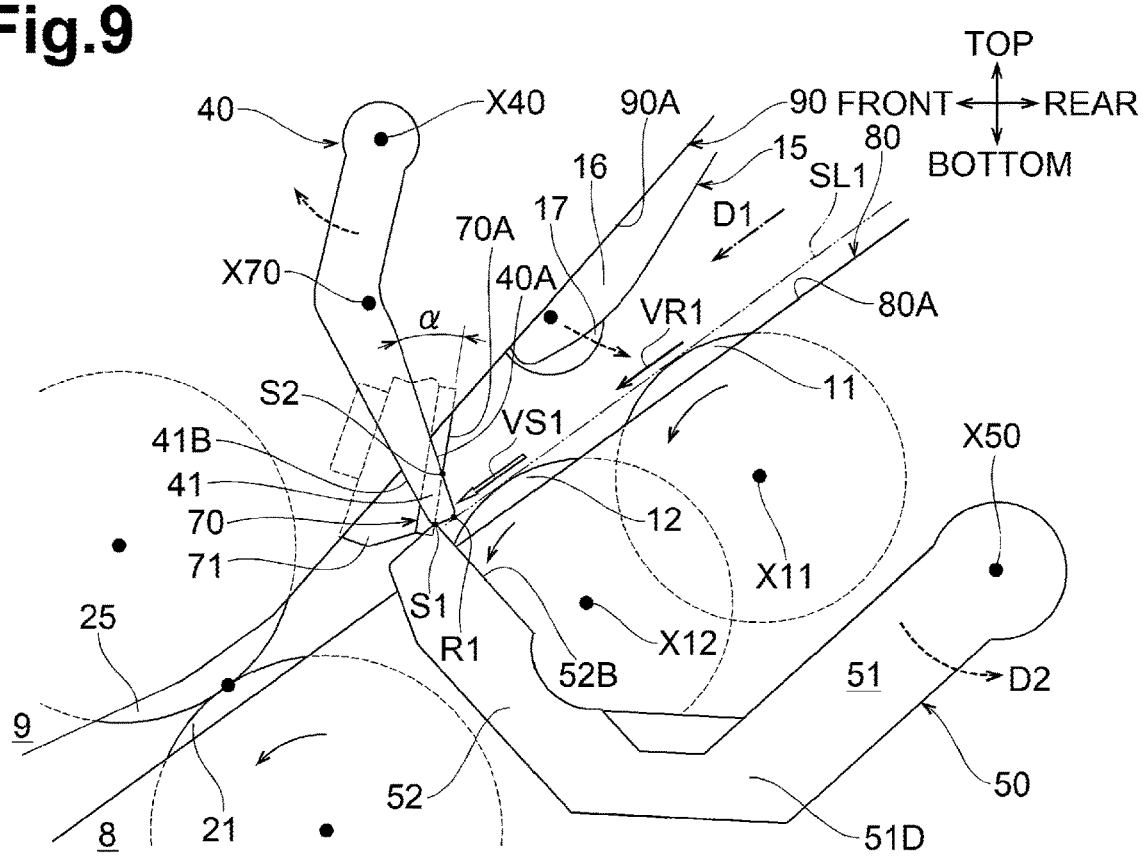
FIG. 9 schematically illustrates relative positional relationships among the first feed roller, the second feed roller, the pressing member, the separator, the stopper, the restriction member, and other components.
Figure 10:
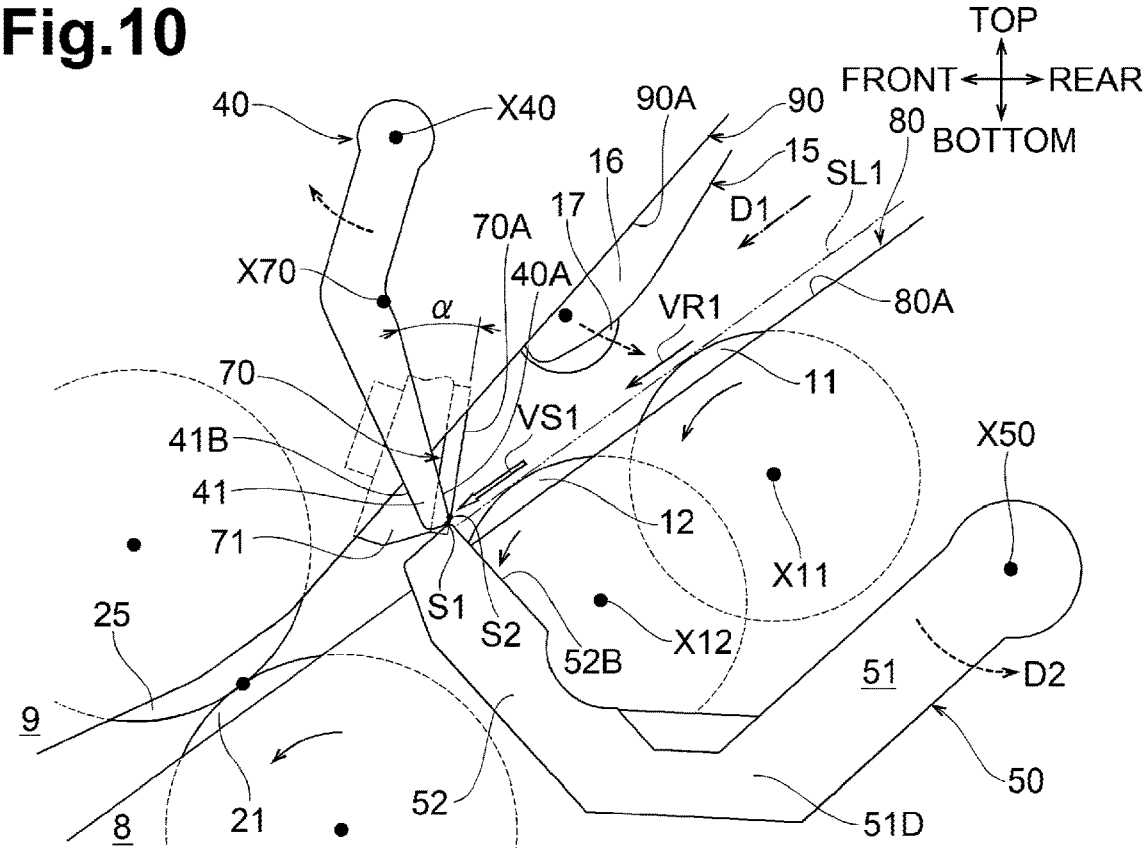
FIG. 10 schematically illustrates relative positional relationships among the first feed roller, the second feed roller, the pressing member, the separator, the stopper, the restriction member, and other components.

As illustrated in FIG. 9, which is an illustration viewed in the direction of the rotation axis X11 or X12, when the stopper 40 moves from the first position further toward the second position, the intersection point S2 of the separation surface 70A and restriction surface 40A moves further below a portion of the guide surface 90A. As FIGS. 7-9 illustrate the movement of the intersection point S2, while the stopper 40 moves from the first position toward the second position, the restriction surface 40A of the stopper 40 has a gradually reduced area contactable with sheets SH at and below the intersection point S2, and a gradually increased area contactable with sheets SH at and above the intersection point S2.

As illustrated in FIG. 10, which is an illustration viewed in the direction of the rotation axis X11 or X12, when the stopper 40 moves to the second position, the intersection point S2 of the separation surface 70A and the restriction surface 40A moves further below a part of the guide surface 90A, thus reaching a lower end of the restriction surface 40A. In this state, when the stopper 40 is in the second position, the restriction surface 40A is located entirely, except for its lower end at which the intersection point S2 is located, downstream from the separation surface 70A of the separator 70 in the conveying direction D1.

As illustrated in FIGS. 7-10, the angle α formed by the separation surface 70A and the restriction surface 40A is acute. In this embodiment, the angle α may be at any angle from 15 degrees to 45 degrees.

As illustrated in FIG. 4, the end portion 41 of the stopper 40 has a flat back surface 41B facing downstream in the conveying direction D1. When the stopper 40 is in the first position, the back surface 41B is substantially orthogonal to the support surface 80A.

<Restriction Members>

As illustrated in FIG. 2, the restriction members 50 are disposed at two positions between which the first feed rollers 11 and the second feed rollers 12 are disposed in the left-right direction.

As illustrated in FIG. 5, the left restriction member 50 is connected to a left end portion of a hollow cylindrical member 50A. The right restriction member 50 is connected to a right end portion of the hollow cylindrical member 50A. The hollow cylindrical member 50A is fitted over a transmission shaft 50S that is rotatably supported by a frame (not illustrated) disposed in the first casing 8.

As illustrated in FIG. 4, the transmission shaft 50S defines a first axis X50 extending in the left-right direction parallel to the rotation axes X11, X12. The first axis X50 is located upstream, in the conveying direction D1, from the rotation axis X11 of the first feed rollers 11 and the rotation axis X12 of the second feed rollers 12, and spaced downward from a portion of support surface 80A more than the rotation axes X11, X12 are from the portion of the support surface 80A.

The restriction members 50 are movable about the first axis X50 between a third position illustrated in FIGS. 2, 4, 5, and 7 and a fourth position illustrated in FIG. 6. FIGS. 8 to 12, and 14 illustrate the restriction member 50 in a position midway from the third position toward the fourth position. FIG. 13 illustrates the restriction member 50 in the fourth position.

As illustrated in FIG. 5, the transmission shaft 50S has a left end connected to the second transmission device 62 via the one-way clutch C2. A helical torsion spring 50T illustrated in FIG. 5 urges the restriction members 50 in a direction to move the restriction members 50 from the third position (FIG. 4 and other drawings) toward the fourth position (FIG. 6 and other drawings), that is, in a direction to retreat the restriction members 50 below a portion of the support surface 80A. The direction in which the helical torsion spring 50T urges the restriction members 50 is referred to as a pivot direction D2. The helical torsion spring 50T is an example of an urging member of the disclosure.

As illustrated in FIG. 4, each restriction member 50 includes a first portion 51 and a second portion 52. The first portion 51 extends along the conveying direction D1 frontward and downward from a location close to the first axis X50. The first portion 51 is spaced apart from the support surface 80A further than the first feed rollers 11 and the second feed rollers 12 are. The second portion 52 is continuous with a downstream end portion 51D of the first portion 51 in the conveying direction D1. The second portion 52 extends upward from the downstream end portion 51D of the first portion 51 toward the conveying path P1.

The second portion 52 has, in its upper portion, an abutment surface 52B. The abutment surface 52B is a flat surface facing upstream in the conveying direction D1. More specifically, the restriction member 50 is substantially L-shaped when viewed in the direction of the rotation axis X11 or X12.

The lower chute 80 includes a contact positioning portion 89. The contact positioning portion 89 is a rib partially defining a downward recessed portion, which is covered with the lower cover 85. The contact positioning portion 89 is located in a position facing the first portion 51 of the restriction member 50 from below. When the first portion 51 contacts the contact positioning portion 89, the restriction members 50, which are urged by the helical torsion spring 50T illustrated in FIG. 5 to pivot in the pivot direction D2, are located in the fourth position illustrated in FIG. 6 and other drawings.

When the controller 2 rotates the motor M1 backward, the one-way clutch C2 illustrated in FIG. 5 becomes engaged, and the second transmission device 62 transmits the drive force of the motor M1 to the transmission shaft 50S. The transmission shaft 50S and the hollow cylindrical member 50A thus rotate about the first axis X50 in a direction opposite to the pivot direction D2 as illustrated in FIG. 4. The restriction members 50 connected to the hollow cylindrical member 50A pivot in the direction opposite to the pivot direction D2 against the urging force of the helical torsion spring 50T, moving to the third position illustrated in FIG. 4 and other drawings.

In the embodiment, the motor M1 is a stepping motor. The restriction members 50 in the third position are controlled by the controller 2 to be precisely held in a predetermined position, after the motor M1 rotates backward at a predetermined rotation angle and is held at the rotation angle while energized.

When the controller 2 rotates the motor M1 forward, the one-way clutch C2 becomes disengaged, and the drive force of the motor M1 is not transmitted to the transmission shaft 50S. As illustrated in FIG. 6, the transmission shaft 50S and the hollow cylindrical member 50A rotate about the first axis X50 in the pivot direction D2 under the urging force of the helical torsion spring 50T. The restriction members 50, which are connected to the hollow cylindrical member 50A, pivot in the pivot direction D2, retreating below the portion of the support surface 80A and to the fourth position.

In this state, the outer race of the one-way clutch C2 in the second transmission device 62 remains connected to the motor M1. The outer race of the one-way clutch C2 rotates in the pivot direction D2 at a rotation speed in accordance with a reduction ratio of the second transmission device 62. The inner race of the one-way clutch C2 rotates in the pivot direction D2 together with the transmission shaft 50S, which is urged by the helical torsion spring 50T, but the one-way clutch C2 is structured such that the inner race does not outpace the outer race. The second transmission device 62 has a predetermined reduction ratio to greatly reduce the rotation speed of the motor M1 to follow the second transmission device 62 via the inner and outer races of the one-way clutch C2 during a period where the restriction member 50 starts pivoting from the third position illustrated in FIG. 4 and other drawings, retreats below the portion of the support surface 80A until the first portion 51 contacts the contact positioning portion 89, and then is located in the fourth position illustrated in FIG. 6 and other drawings. The setting of the reduction ratio of the second transmission device will be described in detail later.

As illustrated in FIG. 4, the restriction member 50 in the third position holds the stopper 40 in the first position by contact with the end portion 41 of the stopper 40 in the first position from a downstream side in the conveying direction D1. More specifically, when the restriction member 50 is in the third position, the abutment surface 52B of the second portion 52 protruding through the support surface 80A contacts the back surface 41B of the stopper 40, restricting the stopper 40 from moving from the first position to the second position. The end portion 41 of the stopper 40 held in the first position aligns the ends of sheets SH supported on the support surface 80A.

As illustrated in FIGS. 7-12, which are illustrations viewed in the direction of the rotation axis X11 or X12, a support point S1 at which the restriction member 50 supports the end portion 41 of the stoppers 40 is defined. As illustrated in FIG. 7, when the restriction member 50 is in the third position, the support point S1 is located on a lower portion of the abutment surface 52B of the second portion 52.

Figure 11:
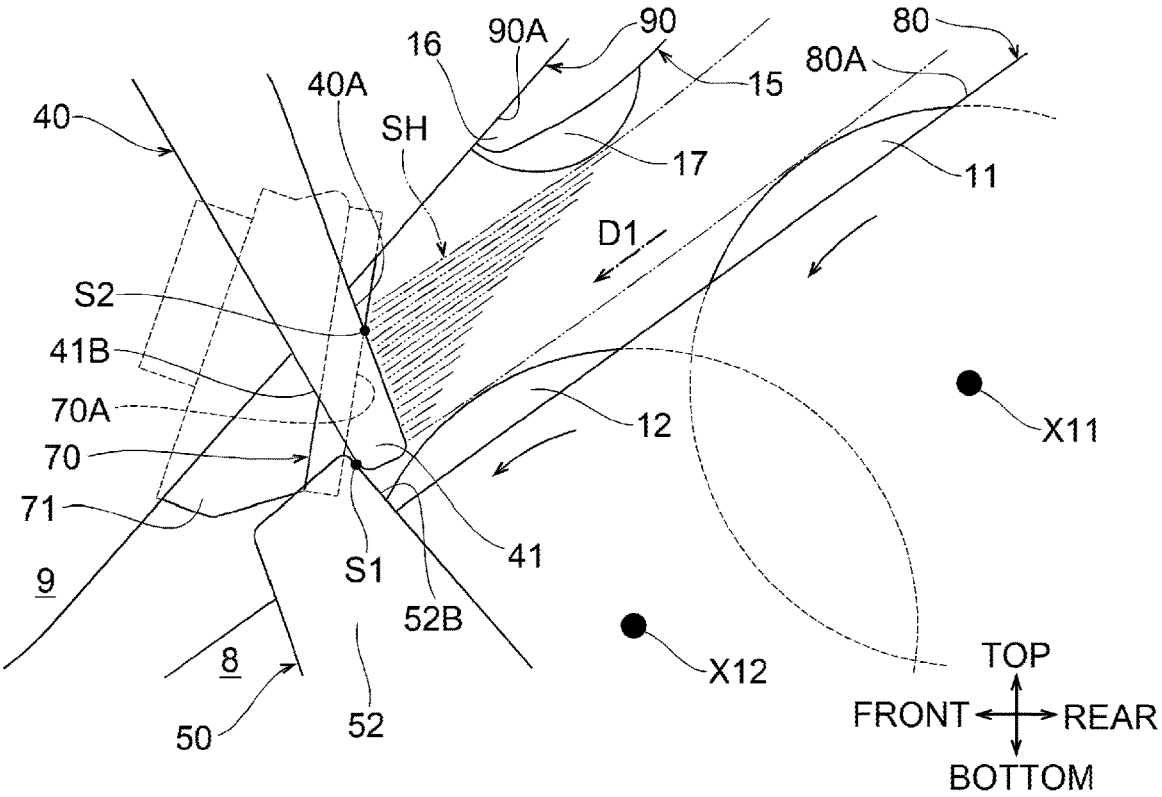
FIG. 11 is an enlarged view of FIG. 8, schematically illustrating operations of the separator and the stopper in association with leading edges of stacked sheets.

As illustrated in FIGS. 8 and 11, when the restriction member 50 moves toward the fourth position, the stopper 40 is pressed by sheets SH toward the second position. The support point S1 thus moves toward an upper end of the abutment surface 52B.

As illustrated in FIGS. 9 and 11, when the restriction member 50 moves further toward the fourth position, the stopper 40 moves further toward the second position. The support point S1 thus reaches the upper end of the abutment surface 52B. As illustrated in FIG. 10, when the restriction member 50 moves further toward the fourth position, the stopper 40 moves to the second position. The support point S1 thus moves to the restriction surface 40A along a lower end surface of the end portion 41 of the stopper 40, and then the second portion 52 of the restriction member 50 moves downward apart from the end portion 41 of the stoppers 40.

In other words, when the stoppers 40 moves from the first position to the second position, the restriction member 50 continues to support the end portion 41 of the stopper 40 while moving the support point S1, and restricts movement of the stopper 40 accordingly.

As illustrated in FIGS. 6 and 13, when the restriction member 50 moves from a position illustrated in FIG. 10 to the fourth position, the abutment surface 52B retreats to a position where the abutment surface 52B does not protrudes from the support surface 80A. The restriction member 50 thus does not interfere with the conveyance of the sheets SH.

When the restriction member 50 moves to the fourth position and the stopper 40 is not pressed by any sheets SH, the stopper 40 urged by the helical torsion spring 40T returns to the first position from the second position.

<Location of Support Point at which Restriction Member Supports Stopper>

As illustrated in FIG. 7, a first x-axis X1 and a first y-axis Y1 are provided to define four quadrants. The first x-axis X1 having the first axis X50 as a first origin extends parallel to the support surface 80A. The first y-axis Y1 is orthogonal to the first x-axis X1, passing through the first origin, which is the first axis X50. A portion of the first x-axis X1 upstream from the first origin in the conveying direction D1, and a portion of the first y-axis Y1 upward from the first origin defines a second quadrant Q2 of the four quadrants.

The support point S1 at which the restriction member 50 supports the stopper 40 is in the second quadrant Q2.

<Intersection Point of Separation Surface and Restriction Surface>

As illustrated in FIG. 7, a second x-axis X2 and a second y-axis Y2 are provided to define four quadrants. The second x-axis X2 having a second axis X40 as a second origin extends parallel to the support surface 80A. The second y-axis Y2 is orthogonal to the second x-axis X2, passing through the first origin, which is the second axis X40. A portion of the second x-axis X2 upstream from the second origin in the conveying direction D1, and a portion of the second y-axis Y2 downward from the first origin define a third quadrant Q3 of the four quadrants.

An intersection point S2 of the separation surface 70A and the restriction surface 40A is in the third quadrant Q3.

<Setting Reduction Ratio of Second Transmission Device>

As illustrated in FIGS. 7-9, a tangent SL1 and an intersection point R1 are defined. The tangent SL1 extends in parallel to the support surface 80A and passes through a point on an outer peripheral surface of each of the first feed roller 11 and the second feed roller 12. The intersection point R1 is at which the tangent SL1 and the restriction surface 40A cross. At the intersection point R1, the leading edge of the lowermost sheet SH, which are one of sheets SH conveyed by the first feed roller 11 and the second feed roller 12, contacts the restriction surface 40A.

As illustrated in FIGS. 8 and 9, the intersection point R1 moves down toward the lower end of the restriction surface 40A, as the stopper 40 moves from the first position illustrated in FIG. 7 toward the second position. When the stopper 40 reaches the second position illustrated in FIG. 10, the lower end of the restriction surface 40A is slightly above the tangent SL1 and the lower end of the separation surface 70A, and the tangent SL1 and the restriction surface 40A do not cross each other.

As illustrated in FIGS. 7-10, the first feed roller 11 and the second feed roller 12 which rotate in the conveying direction have a circumferential velocity VR1. The circumferential velocity VR1 is a speed at which the outer peripheral surface of each of the first feed roller 11 and the second feed roller 12 contacts a sheet SH supported on the support surface 80A and conveys the sheet SH downstream in the conveying direction. While the stopper 40 moves from the first position to the second position, the intersection point R1 moves with a movement velocity in a direction parallel to the tangent SL1. The movement velocity at the intersection point is defined as a specified movement velocity VS1.

Figure 14:
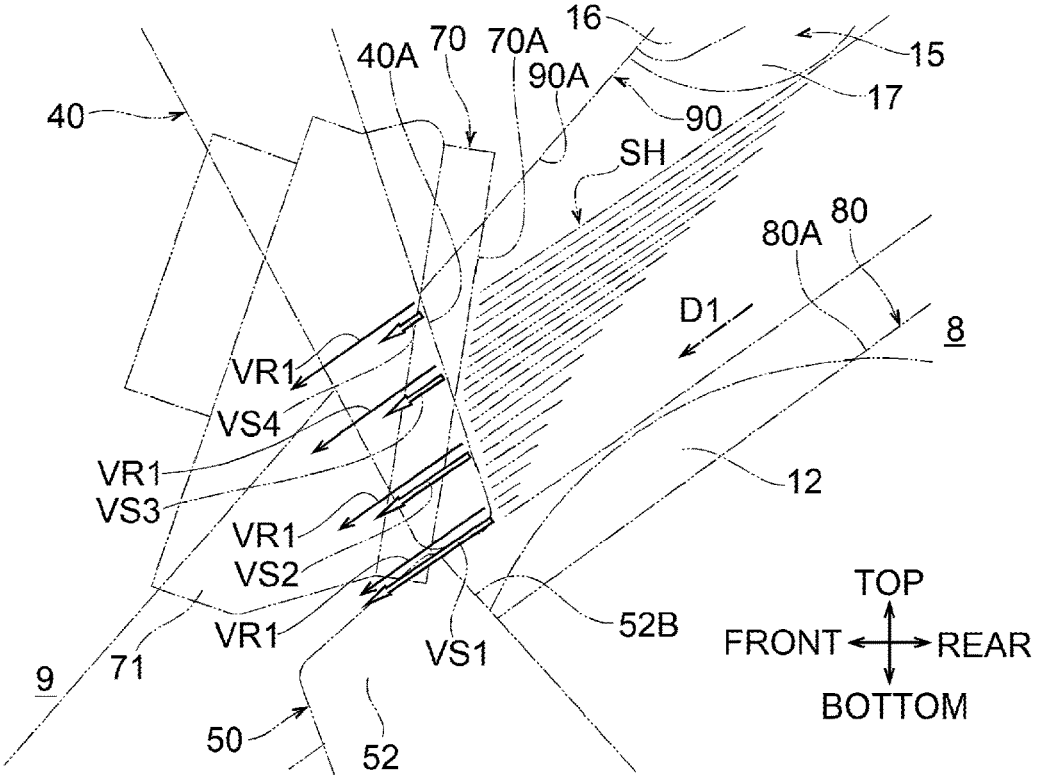
FIG. 14 schematically illustrates movement velocities at the stopper in relation to the second feed roller.

In the embodiment, as illustrated in FIG. 14, the restriction member 50 is configured to restrict the movement of the stopper 40 such that the specified movement velocity VS1 is the same as the circumferential velocity VR1, based on the setting of the reduction ratio of the second transmission device 62, which will be described later. In accordance with this, specified movement velocities VS2, VS3, VS4, at positions on the restriction surface 40A of the stopper 40, are progressively smaller the farther they are from the intersection point R1 and the closer they are to the second axis X40. Accordingly, the specified movement velocities VS2, VS3, VS4 are smaller than the circumferential velocity VR1 and the specified movement velocity VS1.

Here, "the specified movement velocity VS1 is the same as the circumferential velocity VR1" may refer to the specified movement velocity VS1 being substantially the same as the circumferential velocity VR1. In one example, the specified movement velocity VS1 is substantially the same as the circumferential velocity VR1 if the specified movement velocity VS1 falls within a range of plus or minus 5 percent of the circumferential velocity VR1. For example, when the first feed roller 11 and the second feed roller 12 are 20 mm in diameter, the range of plus or minus 5 percent corresponds to an error of plus or minus 1 mm of the roller diameter, and the circumferential velocity VR1 may vary in a narrow range corresponding to the error of plus or minus 1 mm of the roller diameter. Such variation, however, has little effect on setting of the specified movement velocity VS1.

The rotational speed of the motor M1 is represented by Rm. The reduction ratio of the first transmission device 61 is represented by Np. The reduction ratio of the second transmission device 62 is represented by Ns.

As illustrated in FIG. 7, Lp represents the diameter of the first feed roller 11 and the second feed roller 12. R2 represents a contact point at which the restriction member 50 and the stopper 40 in the first position contact each other. In FIG. 7, the contact point R2 is the same as the support point S1.

Ls represents a distance from the first axis X50 to the contact point R2. SL2 represents a straight line connecting the first axis X50 and the contact point R2. The line SL2 and the tangent SL1 form an angle θ.

The circumferential velocity VR1 is calculated by the following formula:

$$VR1=Rm\times Np\times 2\times\pi\times Lp \quad \text{(Formula 1)}$$

The specified movement velocity VS1 is regarded as substantially the same as a velocity VC1 at which the contact point R2 moves in a direction parallel to the tangent SL1, and calculated by the following formula:

$$VS1=Rm\times Ns\times 2\times\pi\times Ls\times\sin\theta \quad \text{(Formula 2)}$$

More specifically, a velocity VC at which the contact point R2 moves when the restriction member 50 pivots about the first axis X50 is obtained by Rm×Ns×2×π×Ls. The velocity VC1, which is substantially the same as the specified movement velocity VS1, is obtained by multiplying the velocity VC by sin θ.

Next, formulas 1 and 2 lead to a design requirement for the reduction ratio Ns of the second transmission device 62. This design requirement includes equating the circumferential velocity VR1 with the specified movement velocity VS1 which, applying formulas (1) and (2), results in:

$$Rm\times Np\times 2\times\pi\times Lp=Rm\times Ns\times 2\times\pi\times Ls\times\sin\theta$$

This equality can be reduced to the following:

$$Np\times Lp=Ns\times Ls\times\sin\theta$$

Consequently, the reduction ratio Ns of the second transmission device 62 is set in such a manner as to satisfy the following formula:

$$Ns=Np\times Lp/(Ls\times\sin\theta)$$

This setting satisfies the design requirement of the circumferential velocity VR1 being equal to the specified movement velocity VS1.

<Separation Rollers and Retard Rollers>

As illustrated in FIGS. 2-4 and other drawings, the separation rollers 21 and the retard rollers 25 are located downstream from the first feed rollers 11, the second feed rollers 12, the separator 70, and the stoppers 40 in the conveying direction D1. As illustrated in FIG. 4, the separation roller 21 and the retard roller 25 are located upstream in the conveying direction D1 from the reference line J1, which is the boundary between the support surface 80A and the lower conveyance surface 80G. In other words, the support surface 80A continuously extends from a position upstream from the first feed rollers 11 and the second feed rollers 12 to a position downstream from the separation roller 21 and the retard roller 25 in the conveying direction D1, partially defining the bottom of the conveying path P1.

As illustrated in FIG. 2, the separation rollers 21 are disposed at two positions apart from each other in the left-right direction. As illustrated in FIG. 4, each of the separation rollers 21 is attached to a rotation shaft 21S in a manner rotatable together. The rotation shaft 21S is supported by a frame (not illustrated) in the first casing 8. At least a portion of the outer peripheral surface of each of the separation rollers 21 protrudes through the support surface 80A.

As illustrated in FIG. 3, the second casing 9 includes two retard rollers 25 apart from each other in the left-right direction and exposed from the guide surface 90A at positions corresponding to the separation rollers 21. As illustrated in FIG. 4 and other drawings, each of the retard rollers 25 is rotatably held by a retard roller holder 27 in the second casing 9. Each of the retard rollers 25 is urged toward the separation roller 21 by a corresponding one of compression coil springs 27T attached to an upper surface of the retard roller holder 27. A torque limiter 29 (FIG. 3) is disposed between the retard roller holder 27 and the retard rollers 25.

When the controller 2 rotates the motor M1 forward, the one-way clutch C3 illustrated in FIG. 5 becomes engaged, the third transmission device 63 transmits the drive force of the motor M1 to the separation rollers 21. As illustrated in FIG. 6, the separation roller 21 thus rotates in the conveying direction D1 to convey a sheet SH fed by the first and second feed rollers 11, 12 downstream along the conveying path P1 in the conveying direction D1

In this state, the torque limiter 29 illustrated in FIG. 3 stops the rotation of the retard rollers 25 pressed against the separation rollers 21 when the torque acting the retard rollers 25 is below or equal to a predetermined value. The torque limiter 29 allows the rotation of the retard rollers 25 when the torque acting on the retard rollers 25 exceeds the predetermined value. When a single sheet SH is fed, the retard rollers 25 are allowed to rotate by the torque limiter 29, and rotate in the conveying direction D1 together with the sheet SH, following the rotation of the separation rollers 21. When one or more sheets SH are fed, the retard rollers 25 are stopped by the torque limiter 29, generating a force to stop feeding sheets SH excluding the sheet contacting the separation rollers 42.

<Conveying Rollers, First Reader, Second Reader, and Discharge Rollers>

As illustrated in FIG. 2, the conveying rollers 31A, the first reader 3A and the discharge rollers 32A are disposed in the first casing 8.

The conveying rollers 31A are rotatably supported by the lower chute 80 such that their outer peripheral surfaces are partially exposed through a middle portion of the lower conveyance surface 80G in the front-rear direction.

The first reader 3A is assembled to the lower chute 80 downstream from the conveying roller 31A in the conveying direction D1. Examples of the first reader 3A includes a contact image sensor (CIS) and a charge coupled device (CCD). The reading surface of the first reader 3A facing upward defines the bottom of the conveying path P1 together with the lower conveyance surface 80G.

The discharge rollers 32A are rotatably supported by the lower chute 80 such that their outer peripheral surfaces are partially exposed through a front-end portion of the lower conveyance surface 80G.

As illustrated in FIG. 3, the first pinch rollers 31B, the second reader 3B, and the second pinch rollers 32B are disposed in the second casing 9.

The first pinch rollers 31B are rotatably supported by the upper chute 90 such that their outer peripheral surfaces are partially exposed through a middle portion of the upper conveyance surface 90G in the front-rear direction. The first pinch rollers 31B are urged toward the conveying rollers 31A by an urging spring (not illustrated), and follow the rotation of the conveying rollers 31A.

The second reader 3B is assembled to the upper chute 90 downstream from the first pinch rollers 31B in the conveying direction D1. The second reader 3B may be the same sensor as the first reader 3A. The second reader 3B has a reading surface facing downward and defining the top of the conveying path P1 together with the upper conveyance surface 90G.

The second pinch rollers 32B are rotatably supported by the upper chute 90 such that their outer peripheral surfaces are partially exposed through a front-end portion of the upper conveyance surface 90G. The second pinch rollers 32B are urged toward the discharge rollers 32A by an urging spring (not illustrated), and follow the rotation of the discharge rollers 32A.

When the controller 2 rotates the motor M1 forward, the third transmission device 63 transmits the drive force of the motor M1 to the conveying rollers 31A and the discharge rollers 32A. This allows the conveying rollers 31A and the discharge rollers 32A to rotate in the conveying direction D1. The conveying rollers 31A and the first pinch rollers 31B convey a single sheet SH, which is separated from stacked sheets SH by the separation rollers 21 and the retard rollers 25, toward the first reader 3A and the second reader 3B. The discharge rollers 32A and the second pinch rollers 32B discharge the sheet SH from the most downstream end in the conveying path P1 to the discharge tray 6 after its image is read by the first reader 3A and the second reader 3B.

<Image Reading Operation>

When the image reading apparatus 1 with the above structure is powered on, the controller 2 determines whether any sheet SH is supported on the support surface 80A based on a position of the sheet detector 19. When the controller 2 determines that a sheet SH is supported on the support surface 80A, the controller 2 instructs a user to remove the sheet SH from the support surface 80A. When the controller 2 determines that no sheets SH are supported on the support surface 80A, the controller 2 rotates the motor M1 backward at a predetermined rotation angle, and the second transmission device 62 and the engaged one-way clutch C2 transmit the drive force of the motor M1 to the restriction members 50. Thus, the restriction members 50 move to the third position, retaining the stoppers 40 in the first position. The controller 2 places the image reading apparatus 1 in a standby status.

In this state, the one-way clutches C1, C3 become disengaged, and thus the first feed rollers 11, the second feed rollers 12, and the separation rollers 21 do not rotate.

As illustrated in FIG. 11, when a user places one or more sheets SH on the feed tray 5 and the support surface 80A, the controller 2 determines that the user has placed the sheets SH based on a change in the position of the sheet detector 19. In this state, the restriction surface 40A of the stopper 40, which is held in the first position by the restriction member 50 in the third position, contacts and stops the leading edges of the sheets SH supported on the support surface 80A to restrict the positions of the leading edges of the sheets SH.

This reduces misalignment of leading edges of the sheets SH supported on the support surface 80A. The sheets SH supported on the support surface 80A are pressed toward the first feed rollers 11 and the second feed rollers 12 by the rollers 17 of the pressing member 15.

In response to an instruction to perform the image reading operation, the controller 2 starts controlling the motor M1, the first reader 3A, and the second reader 3B. The controller 2 rotates the motor M1 forward. This causes the one-way clutches C1, C3 to become engaged and the one-way clutch C2 to become disengaged.

The first transmission device 61 and the engaged one-way clutch C1 transmit the drive force of the motor M1 to the first feed rollers 11 and the second feed rollers 12. The third transmission device 63 and the engaged one-way clutch C3 transmit the drive force of the motor M1 to the separation rollers 21. The third transmission device 63 transmits the drive force of the motor M1 to the conveying rollers 31A and the discharge rollers 32A. This allows the first feed rollers 11, the second feed rollers 12, the separation rollers 21, the conveying rollers 31A, and the discharge rollers 32A to rotate in the conveying direction D1.

The second transmission device 62 and the disengaged one-way clutch C2 do not transmit the drive force of the motor M1 to the restriction members 50. The restriction members 50 urged by the helical torsion spring 50T rotate in the pivot direction D2, and move following the second transmission device 62 since the one-way clutch C2 is structured such that the inner race does not outpace the outer race. The restriction members 50 rotate in the pivot direction D2 at the same speed as the outer race of the one-way clutch C2 that rotates at a rotation speed in accordance with the reduction ratio Ns of the second transmission device 62. The first portion 51 of each restriction member 50 contacts the contact positioning portion 89 and each restriction member 50 is located in the fourth position.

The following will describe operations of the separator 70 and the stoppers 40 in relation to leading edges of sheets SH supported on the support surface 80A during a period of time from when the first feed rollers 11 and the second feed rollers 12 start rotating in the conveying direction D1 and the restriction members 50 in the third position starts pivoting in the pivot direction D2 to when the restriction members 50 are located in the fourth position.

As illustrated in FIG. 11, stacked sheets SH, which are located between the first feed roller 11, the second feed roller 12, and the roller 17 of the pressing member 15, are fed by the first feed roller 11 and the second feed roller 12, which start rotating in the conveying direction D1. The restriction surface 40A of the stoppers 40 is pressed by the leading edges of the sheets SH, and thus the stopper 40 pivots downstream in the conveying direction D1. In this state, the restriction member 50 slowly pivots in the pivot direction D2 while supporting the stoppers 40 at the support point S1.

More specifically, as illustrated in FIG. 7, while supported by the restriction member 50, the stopper 40 pivots such that the intersection point R1 of the tangent SL1 and the restriction surface 40A moves at the specified movement velocity VS1 that is the same as the circumferential velocity VR1 of the first feed roller 11 and the second feed roller 12. As illustrated in FIG. 14, the restriction surface 40A of the stopper 40 moves downstream in the conveying direction at the same speed as the leading edge of the lowermost sheet SH at the intersection point R1. This prevents a collision of the leading edge of the lowermost sheet SH with the stopper 40, which may cause the leading edge of the sheet SH to bend. The movement velocities on the restriction surface 40A of the stopper 40 are progressively slower the farther they are from the intersection point R1 and the closer they are to the second axis X40. The restriction surface 40A thus restricts the movement of the sheets SH such that upper sheets SH on and above the lowermost sheet SH move progressively slower than the lowermost sheet SH.

As illustrated in FIG. 11, this allows upper sheets SH, whose leading edges are located at or above the intersection point S2 of the separation surface 70A and the restriction surface 40A, to contact the separation surface 70A and be displaced relative to the sheets thereabove, resulting in their leading edges being aligned in a wedge-shape.

Figure 12:
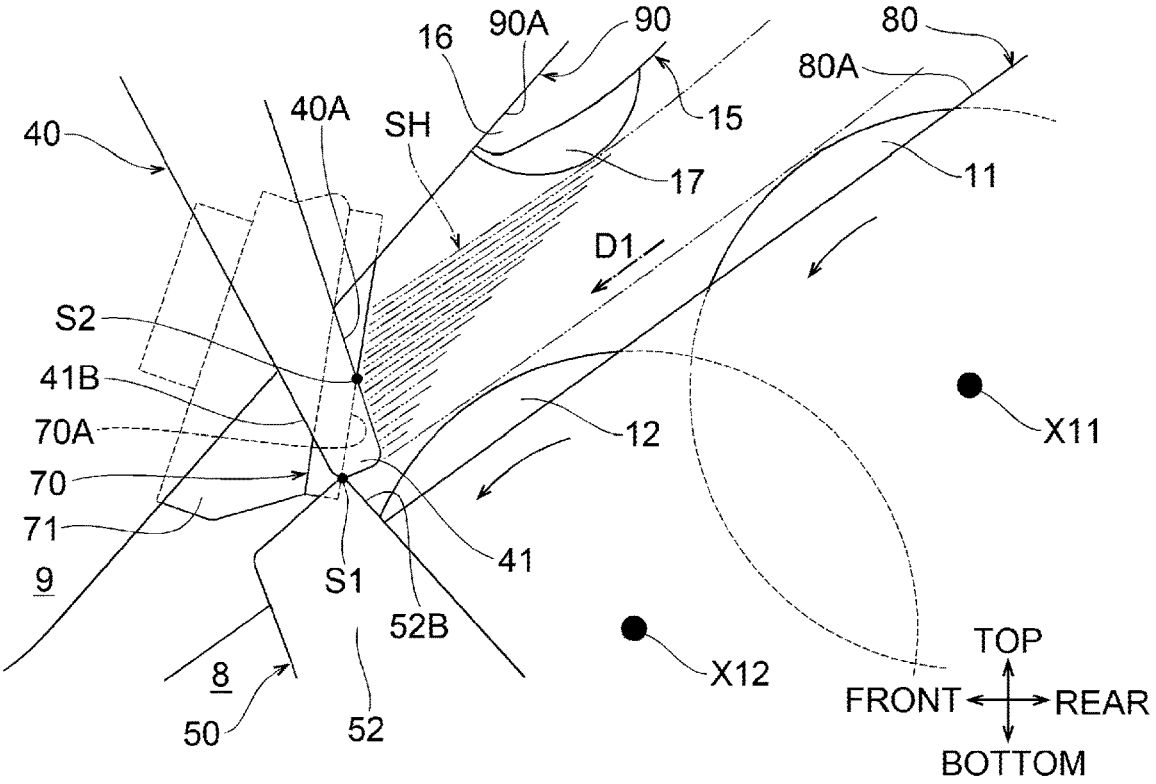
FIG. 12 is an enlarged view of FIG. 9, schematically illustrating the operation of the separator and the stopper in association with the leading edges of the stacked sheets.
Figure 13:
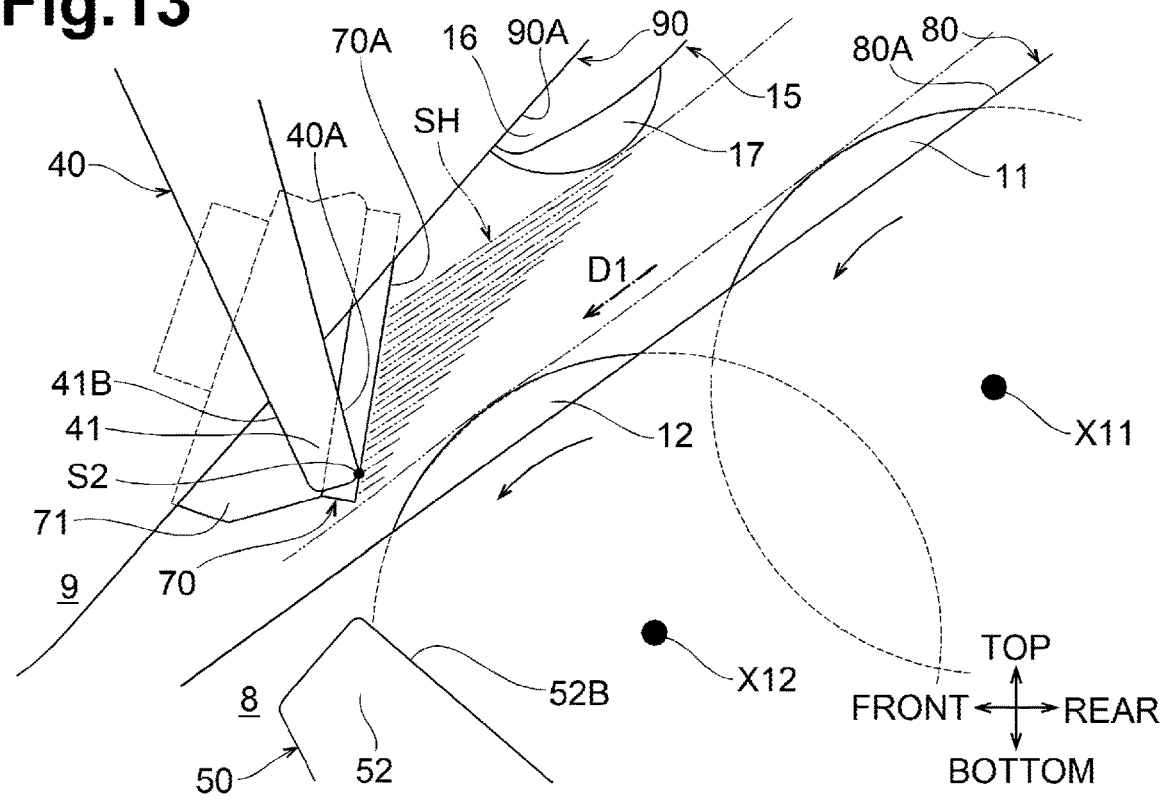
FIG. 13 is an enlarged view of FIG. 6, schematically illustrating the operation of the separator and the stopper in association with the leading edges of the stacked sheets.

As illustrated in FIG. 12, the stacked sheets SH are further conveyed in the conveying direction D1. The restriction surface 40A of the stopper 40 is further pressed by the leading edges of the sheets SH, and thus the stopper 40 moves further downstream in the conveying direction D1. At this time, the intersection point S2 of the separation surface 70A and the restriction surface 40A moves downward since the restriction member 50 continues to support the stoppers 40 at the support point S1 while slowly pivoting in the pivot direction D2.

Concurrently, the restriction surface 40A of the stopper 40 moves downstream in the conveying direction at substantially the same speed as the leading edge of the lowermost sheet SH at the intersection point R1. The restriction surface 40A of the stopper 40 restricts the movement of the sheets SH such that upper sheets SH on and above the lowermost sheet SH move slower than the lowermost sheet SH.

As illustrated in FIG. 12, this allows upper and middle sheets SH, whose leading edges are located at and above the intersection point S2, to contact the separation surface 70A to be displaced relative to the sheets thereabove, resulting in their leading edges being aligned in a wedge shape.

After that, as illustrated in FIG. 10, the support point S1 at which the restriction member 50 supports the stoppers 40 reaches the lower end of the stopper 40. Then, as illustrated in FIG. 13, as the restriction member 50 is spaced apart from the stoppers 40 below the portion of the support surface 80A, the intersection point S2 of the separation surface 70A and the restriction surface 40A moves further downward, reaching the lower end of the restriction surface 40A.

Concurrently, the restriction surface 40A of the stopper 40 moves downstream in the conveying direction at substantially the same velocity as the leading edge of the lowermost sheet SH at the intersection point R1. The restriction surface 40A of the stopper 40 restricts the movement of the sheets SH such that upper sheets SH on and above the lowermost sheet SH move slower than the lowermost sheet SH.

As illustrated in FIG. 13, this allows the sheets SH from top to bottom contacting the separation surface 70A to be displaced relative to the sheets thereabove, resulting in their leading edges being aligned in a wedge shape. A lowermost one of the sheets SH passes through the lower end of the separator 70 and is conveyed downstream in the conveying direction D1.

As illustrated in FIG. 6, a sheet SH having passed though the stopper 40 and the separator 70 is nipped between the separation roller 21 and the retard roller 2. The separation roller 21 and the retard roller 25 separate multiple sheets SH from one another and convey each separated sheet SH downstream in the conveying direction D1.

The conveying roller 31A and the first pinch roller 31B convey each separated sheet SH toward the first reader 3A and the second reader 3B. The first reader 3A and the second reader 3B read an image of each sheet SH, and transmit the image information to the controller 2. The discharge roller 32A and the second pinch roller 32B discharge the sheet SH to the discharge tray 6 after its image is read by the first reader 3A and the second reader 3B.

To end the image reading operation, the controller 2 rotates the motor M1 backward at a predetermined angle. The restriction members 50 then move to the third position to hold the stoppers 40 in the first position. The controller 2 places the image reading apparatus 1 in a standby status.

<Control for Sheet Conveying Velocity at Jobs for Conveying Multiple Sheets>

Figure 15:
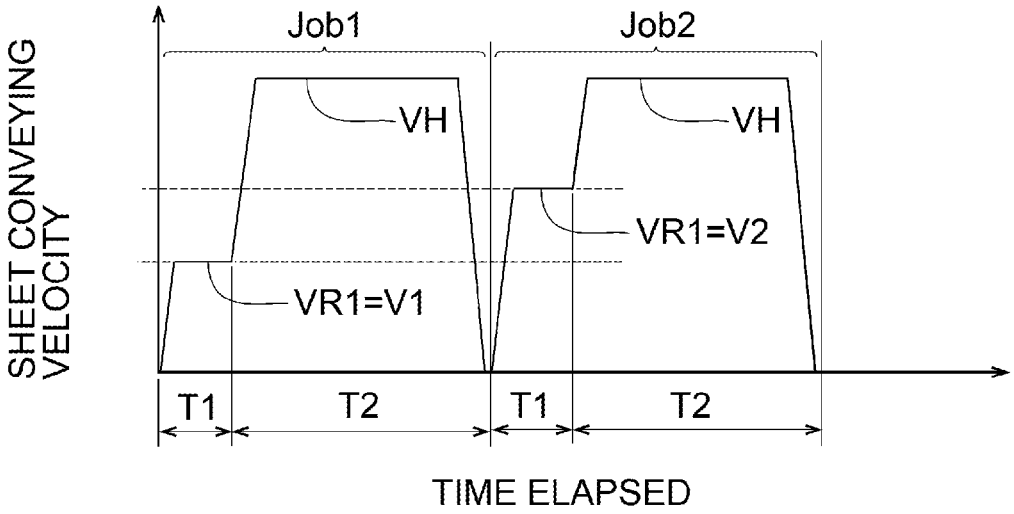
FIG. 15 is a chart illustrating a change in sheet conveying velocity when performing jobs for conveying multiple sheets.

In the example illustrated in FIG. 15, when performing jobs for conveying multiple sheets SH, the controller 2 may change the circumferential velocity VR1 at which the first feed roller 11 and the second feed roller 12 feed a sheet SH by controlling the rotation speed of the motor M1 for forward rotation.

As for jobs for conveying multiple sheets SH, a job relating to a first sheet SH is regarded as a job 1. A job relating to a second sheet SH is regarded as a job 2. Jobs relating to third and later sheets SH are similar to the job 2, and thus their description will be omitted.

The job 1 and the job 2 are each divided into a section T1 where the first feed roller 11 and the second feed roller 12 conveys a sheet SH, and a section T2 where the conveying roller 31A conveys the sheet SH. In the section T1, a velocity for conveying the sheet SH is the circumferential velocity VR1 of the first feed roller 11 and the second feed roller 12. In the section T2, a velocity for conveying the sheet SH is a circumferential velocity VH of the conveying roller 31A.

The circumferential velocity VH of the conveying roller 31A is set higher than the circumferential velocity VR1 of the first feed roller 11 and the second feed roller 12. In the section T2, the first feed roller 11 and the second feed roller 12 are pulled by the sheet SH conveyed by the conveying roller 31A, the one-way clutch C1 becomes disengaged, and thus the first feed roller 11 and the second feed roller 12 rotate with the rotation of the conveying roller 31A.

In the section T1 of the job 1, the circumferential velocity VR1 of the first feed roller 11 and the second feed roller 12 is set to a first velocity V1. In the section T1 of the job 2, the circumferential velocity VR1 is set to a second velocity V2. The first velocity V1 is lower than the second velocity V2. Switching between the first velocity V1 and the second velocity V2 takes place when the controller 2 changes the rotation speed of the motor M1 for forward rotation. In the example illustrated in FIG. 15, the first velocity V1 and the second velocity V2 are invariant until the section T1 ends.

When starting the job 1, the controller 2 controls that, in the section T1, the first sheet SH supported on the support surface 80A is conveyed at the circumferential velocity VR1, where VR1=V1, and VR1<V2. A period during which the circumferential velocity VR1 equals the first velocity V1 (VR1=V1) is required at least until the restriction member 50 retreats below the support surface 80A. Namely, during this period, the stopper 40 needs to move from the first position to the second position, such that the leading edge of the first sheet SH conveyed at the first velocity V1, which is slower than the second velocity V2, completely contacts the separation surface 70A.

Then, the controller 2 controls that, in the section T2, the first sheet SH is conveyed at the circumferential velocity VH. The controller 2 then stops the motor M1 when the first sheet SH, whose images are read by the first reader 3A and the second reader 3B, is discharged to the discharge tray 6.

When starting the job 2, the controller 2 controls that, in the section T1, the second sheet SH supported on the support surface 80A is conveyed at the circumferential velocity VR1, where VR1=V2, and V2>V1. In this state, sheets SH including the second sheet SH supported on the support surface 80A are in contact with the separation surface 70A and aligned in a wedge shape, and thus the second sheet SH is conveyed smoothly.

Then, the controller 2 controls that, in the section T2, the second sheet SH is conveyed at the circumferential velocity VH. The controller 2 then stops the motor M1 when the second sheet SH, whose images are read by the first reader 3A and the second reader 3B, is discharged to the discharge tray 6. Jobs relating to the third and later sheets SH are performed similarly to the job 2.

In the example illustrated in FIG. 15, the controller 2 stops the motor M1 after conveying of each sheet SH is completed, to maintain an interval between each sheet SH. Stopping of the motor M1, however, may be omitted.

<Effects>

In the image reading apparatus 1 according to the embodiment, as illustrated in FIGS. 7-12, while the stopper 40 moves from the first position to the second position, the restriction member 50 continuously supports the stopper 40 to restrict movement of the stopper 40. This allows the stopper 40 to slowly move from the first position illustrated in FIG. 4 and other drawings to the second position illustrated in FIG. 6 and other drawings, preventing sudden movement of the stoppers 40 from the first position to the second position due to being pressed by the sheets SH.

Following the slow movement of the stopper 40 as illustrated in FIGS. 11-13, the sheets SH conveyed by the first feed rollers 11 and the second feed rollers 12 slowly move in contact with the separator 70. The leading edges of the sheets SH contact the separator 70 gradually.

As illustrated in FIG. 14, the restriction member 50 restricts the movement of the stopper 40 such that the specified movement velocity VS1 is the same as the circumferential velocity VR1 of the first feed roller 11 and the second feed roller 12. This prevents a collision of the leading edge of the sheet SH with the stopper 40, which may cause the leading edges of the sheet SH to bend.

The image reading apparatus 1 prevents a stack of sheets SH from colliding with the separator 70, which may result in some of the sheets SH being forced out of alignment at the separator 70. The stacked sheets SH thus can be reliably aligned, and sequentially conveyed downstream in the conveying direction D1.

The image reading apparatus 1 according to the embodiment thus prevents multiple sheets from being fed at one time.

As illustrated in FIGS. 4, 6, and other drawings, the image reading apparatus 1 includes the restriction members 50 pivotable about the first axis X50. When the stoppers 40 move to the second position illustrated in FIG. 6, the restriction members 50 move downward apart from the stoppers 40 until it is located below a portion of the support surface 80A. This structure enables the restriction members 50 to hold the stoppers 40 in the first position illustrated in FIG. 4 near the support surface 80A. The stoppers 40 are thus precisely and reliably positioned in the first position.

In the image reading apparatus 1, as illustrated in FIGS. 4 and 6 and other drawings, the restriction member 50 includes the first portion 51 and the second portion 52. This structure facilitates preventing the restriction member 50 from interfering with the first feed rollers 11 and the second feed rollers 12, thus providing space for locating the restriction member 50.

As illustrated in FIG. 5, the image reading apparatus 1 includes the first transmission device 61, the second transmission device 62, the one-way clutch C2, and the torsion coil spring 50T. The restriction members 50 hold the stoppers 40 in the first position when the motor M1 rotates backward, and retreats below the portion of the support surface 80A when the motor M1 rotates forward. The restriction members 50 follows the second transmission device 62 via the one-way clutch C2 until it retreats below the portion of the support surface 80A. In other words, the image reading apparatus 1 enables the controller 2 to switch the motor 1 between the forward and backward rotation, thus facilitating driving of the first feed roller 11 and the second feed roller 12 and moving of the restriction members 50.

In the image reading apparatus 1, the reduction ratio Ns of the second transmission device 62 is set from the following: Ns=Np×Lp/(Ls×sin θ). As illustrated in FIG. 7, the restriction member 50 thus can reliably restrict the movement of the stopper 40 such that the specified movement velocity VS1 is the same as the circumferential velocity VR1 of the first feed roller 11 and the second feed roller 12.

In the image reading apparatus 1, as illustrated in FIG. 15, the controller 2 controls the motor M1, in the section T1 of the job 1, in a manner such that VR1=V1, and V1<V2. The circumferential velocity VR1 is thus set slower than the second velocity V2 at the job 2 at least until the restriction member 50 retreats below the portion of the support surface 80A. As for stacked sheets SH supported on the support surface 80A, the first sheet SH may collide with the separator 70 while the stopper 40 moves from the first position to the second position. Thus, in the section T1 of the job 1, the controller 2 controls the motor M1 such that VR1=V1, and the first sheet SH is slowly conveyed accordingly. This enables the leading edge of the first sheet SH to conform to the separator 70. In the section T1 of the job 2 or later jobs, there is no need to set the circumferential velocity VR1 to the second velocity V2, and the second and later sheets SH can be conveyed smoothly.

In the image reading apparatus 1, the stoppers 40 are simply pivotable about the second axis X40. The stoppers 40 thus move between the first position illustrated in FIG. 4 and other drawings and the second position illustrated in FIG. 6 and other drawings. As illustrated in FIG. 14, the specified movement velocities VS2, VS3, VS4, at positions on the restriction surface 40A of the stopper 40, are progressively smaller the farther they are from the intersection point R1 and the closer they are to the second axis X40. Accordingly, the specified movement velocities VS2, VS3, VS4 are smaller than the circumferential velocity VR1 and the specified movement velocity VS1. Thus, the upper sheets SH of the stacked sheets SH are more subject to a force from the stopper 40 to stop conveying sheets. This allows each of stacked sheets SH to contact the separation surface 70A gradually in order starting from the top sheet. The leading edges of the stacked sheets SH can be aligned in a wedge shape.

In the image reading apparatus 1, the above-described structure prevents multiple sheets from being fed at the same time, and thus allows the first reader 3A and the second reader 3B to perform image reading operation reliably.

The disclosure has been described based on the embodiment, but is not limited to the embodiment, and may be modified freely without departing from the sprit and scope of the invention.

The embodiment shows, but is not limited to, that the restriction members 50 restrict the movement of the stoppers 40 such that the specified movement velocity VS1 is the same as the circumferential velocity VR1 of the first feed roller 11 and the second feed roller 12. For example, the restriction members 50 may restrict the movement of the stoppers 40 such that the specified movement velocity VS1 is greater than or equal to the circumferential velocity VR1. Such change can be achieved by changing the reduction ratio Ns of the first transmission device 62 as necessary. In this case, the reduction ration Ns of the second transmission device 62 may be set from the following:

$$Ns \geq NP \times Lp/(Ls \times \sin\theta).$$

The embodiment shows, but is not limited to that, the stoppers 40 pivot between the first position and the second position. Alternatively, the stoppers may be translated between the first position and the second position.

The embodiment shows, but is not limited to that, the image reading apparatus 1 employs the first feed rollers 11 and the second feed rollers 12 which are arranged in the conveying direction. Alternatively, the second feed rollers 12 may be eliminated and the first feed rollers 11 only may be employed.

The disclosure may apply to other apparatuses such as an image forming apparatus and a multi-function apparatus as well as the image reading apparatus.

What is claimed is:

1. A sheet feeding apparatus comprising:

a support member having a support surface configured to support stacked sheets;

a feed roller rotatable about a rotation axis located below a portion of the support surface, the feed roller having an outer peripheral surface, at least a portion of the outer peripheral surface protruding through the support surface, the feed roller being configured to feed the sheets supported on the support surface downstream in a conveying direction;

a separation roller disposed downstream from the feed roller in the conveying direction, the separation roller being configured to separate a single sheet from the sheets fed by the feed roller and convey the sheet downstream in the conveying direction;

a separator disposed upstream from the separation roller in the conveying direction, the separator having an upper end and a lower end, the lower end being located downstream from the upper end in the conveying direction, the separator including a separation surface configured to contact leading edges of the sheets supported on the support surface, the separation surface facing upstream in the conveying direction;

a stopper, when viewed in a direction of the rotation axis, disposed at least partially overlapping the separator, the stopper being movable about an axis located upstream from the separator in the conveying direction, between a first position and a second position, downstream from the first position in the conveying direction, the stopper including a restriction surface configured to contact the leading edges of the sheets supported on the support surface, the restriction surface facing upstream in the conveying direction, wherein when the stopper is in the first position, the stopper crosses the support surface and partially overlaps the separator so that the restriction surface of the stopper is upstream of the separation surface of the separator in the conveying direction, and the stopper restricts leading edges of the sheets supported on the support surface from contacting the separation surface of the separator, and wherein when the stopper is in the second position, the stopper is spaced apart from the support surface and allows the leading edges of the sheets to contact the separation surface of the separator; and a restriction member configured to hold the stopper in the first position and to restrict movement of the stopper while continuing to support the stopper moving from the first position to the second position, wherein, when viewed in the direction of the rotation axis, a tangent extends in parallel to the support surface and passes through a point on an outer peripheral surface of the feed roller, and the tangent and the restriction surface of the stopper crosses at an intersection point, wherein, when the stopper moves from the first position to the second position, the intersection point moves with a movement velocity in a direction parallel to the tangent, the movement velocity at the intersection point being defined as a specified movement velocity, and wherein the restriction member is configured to restrict movement of the stopper such that the specified movement velocity is greater than or equal to a circumferential velocity of the feed roller.

2. The sheet feeding apparatus according to claim 1, wherein the restriction member is configured to restrict the movement of the stopper such that the specified movement velocity is equal to the circumferential velocity of the feed roller.

3. The sheet feeding apparatus according to claim 1, wherein the restriction member is pivotable about a first axis extending parallel to the rotation axis in a position below a portion of the support surface, the restriction member being configured to, when the stopper moves to the second position, separate from the stopper and retreat below the portion of the support surface.

4. The sheet feeding apparatus according to claim 3, wherein the restriction member includes a first portion and a second portion, the first portion extending downstream from a location close to the first axis in the conveying direction, the second portion extending upward from a downstream end portion of the first portion and being configured to support the stopper.

5. The sheet feeding apparatus according to claim 3, further comprises:

a motor configured to rotate forward or backward to generate a drive force;

a first transmission device configured to transmit the drive force of the motor to the feed roller, the first transmission device being configured to, when the motor rotates forward, rotate the feed roller in the conveying direction;

a second transmission device configured to transmit the drive force of the motor to the restriction member;

a one-way clutch disposed between the second transmission device and the restriction member, the one-way clutch being configured to, when the motor rotates forward, become disengaged, and to, when the motor rotates backward, become engaged; and an urging member configured to urge the restriction member in a direction to retreat the restriction member below the portion of the support surface, wherein the restriction member is configured to, when the motor rotates backward, hold the stopper in the first position against the urging member, and configured to, when the motor rotates forward, retreat below the portion of the support surface, the restriction member being configured to follow the second transmission device via the one-way clutch until the restriction member retreats below the portion of the support surface.

6. The sheet feeding apparatus according to claim 5, wherein the second transmission device has a reduction ratio Ns defined by a formula $$Ns \geq NP \times Lp/(Ls \times \sin\theta),$$

where Np represents a reduction ratio of the first transmission device, Lp represents a diameter of the feed roller, Ls represents a distance from the first axis to a contact point at which the restriction member and the stopper in the first position contact each other, and θ represents an angle formed between the tangent and a line connecting the first axis and the contact point.

7. The sheet feeding apparatus according to claim 1, wherein the stopper is pivotable about a second axis extending parallel to the rotation axis.

8. The sheet feeding apparatus according to claim 1, further comprising an image reader disposed downstream from the separation roller in the conveying direction and configured to read an image of a sheet fed by the feed roller and the separation roller.

* * * * *